US008385758B2

(12) United States Patent
Nakai

(10) Patent No.: US 8,385,758 B2
(45) Date of Patent: Feb. 26, 2013

(54) IMAGE FORMING DEVICE AND METHOD OF THE SAME

(75) Inventor: Tatsunori Nakai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 531 days.

(21) Appl. No.: 12/654,472

(22) Filed: Dec. 22, 2009

(65) Prior Publication Data

US 2010/0172663 A1 Jul. 8, 2010

(30) Foreign Application Priority Data

Jan. 8, 2009 (JP) ..... 2009-002618

(51) Int. Cl.
*G03G 15/00* (2006.01)

(52) U.S. Cl. ..... 399/45; 399/364; 399/389; 399/391; 399/401; 399/407; 399/410

(58) Field of Classification Search ..... 399/45, 399/85, 364, 389, 391, 401, 407–410
See application file for complete search history.

(56) References Cited

U.S. PATENT DOCUMENTS 6,325,585 B1 * 12/2001 Sasaki et al. ..... 399/407
6,339,685 B1 * 1/2002 Okamoto et al. ..... 399/407
7,281,707 B2 * 10/2007 Moriyama et al. ..... 399/407

FOREIGN PATENT DOCUMENTS

JP A-2002-167077 6/2002

* cited by examiner

*Primary Examiner* — Walter L Lindsay, Jr.
*Assistant Examiner* — Ruth Labombard
(74) *Attorney, Agent, or Firm* — Posz Law Group, PLC

(57) ABSTRACT

An image forming device includes a first medium container for a first printing medium; a second medium container for a second printing medium; a medium feeder for feeding one of the first and second media from one of the first and second medium containers; a special process unit that performs a special process on the first printing medium fed by the medium feeder when image data, including instruction information instructing the special process, is received; a detector that detects a characteristic of the first printing medium; a special process capability determination unit for determining whether or not the special process can be performed based on the characteristic; and a control unit that ejects the printing medium and that causes the second medium to be fed from the second medium container when the special process capability determination unit determines that the special process cannot be performed.

19 Claims, 12 Drawing Sheets

| Tray Name | Sheet Thickness Calculation Value T (μm) |
|---|---|
| First Sheet Tray | TBD |
| Second Sheet Tray | TBD |

Fig. 8A

| Tray Name | Sheet Thickness Calculation Value T (μm) |
|---|---|
| First Sheet Tray | 190 |
| Second Sheet Tray | TBD |

Fig. 8B

| Tray Name | Sheet Thickness Calculation Value T (μm) |
|---|---|
| First Sheet Tray | 190 |
| Second Sheet Tray | 80 |

Fig. 8C

| Type | Thickness Threshold Value |
|---|---|
| Hole Punch Process | 160 μm / sheet |
| Staple Process | 8000 μm / total number of sheet |

Fig. 9

IMAGE FORMING DEVICE AND METHOD OF THE SAME

CROSS REFERENCE

The present application is related to, claims priority from and incorporates by reference Japanese patent application number 2009-002618, filed on Jan. 8, 2009.

TECHNICAL FIELD

The present invention relates to an image forming device that has a special process functions, such as a duplex printing function, a staple function, and a hole punch function. Also, the present invention relates to an image forming method.

BACKGROUND

An image forming device that has a duplex printing function was proposed in JP Laid-Open Publication No. 2002-167077. When the image forming device receives image data from a user terminal through a network, the image forming device determines whether or not the image data has instruction information for duplex printing first.

When the image data has the instruction information for duplex printing, the device turns on a thickness detection sensor located in a conveying path and drives a sheet feeding roller so that the device feeds a sheet stored in a sheet tray by rotation of the sheet feeding roller. The fed sheet is carried to the conveying path, and the thickness of the sheet is detected by the thickness detection sensor. A judgment unit judges whether the detected thickness is greater than or equal to the threshold value. The threshold value represents a predetermined thickness at or above which duplex printing cannot be performed.

The threshold value is set based on the following reasons. When a sheet on which a print process is performed on one side is thick and has large stiffness, a large curl occurs on the sheet because the sheet is carried through the conveying path while receiving a large bending force. When the sheet with the large curl is carried to the conveying path again to perform the print process on a reverse side, there is a high possibility that a paper jam will occur. Based on the reasons discussed above, the image forming device cannot perform duplex printing when the sheet thickness is greater than or equal to a predetermined threshold value in order to prevent the duplex printing process for a sheet that has an inappropriate thickness for duplex printing.

When the detected thickness of the sheet is less than the threshold value, the image forming device judges that the sheet is satisfactory for duplex printing and performs an image forming process and an image fusing process on a first side of the sheet first. The image forming device carries the sheet to a sheet inversion mechanism that is used at the time of the duplex printing process for turning the sheet with reverse-side up. Then, the image forming device performs the image forming process and the image fusing process on the reverse side, or second side, as was done on the first side and ejects the sheet from an outlet.

On the other hand, when the detected thickness is equal to or more than the threshold value, the image forming device judges that the sheet does not qualify for the duplex printing and drives a transferring belt and so on to carry the sheet, which is fed to a conveying path, by the belt rotation for ejecting the sheet from the outlet without printing.

When the image forming device performs the duplex printing process, and when the thickness of the sheet, which is fed from the sheet tray, is equal to or more than the threshold value, the print process is forcibly stopped as discussed above. Therefore, there is a problem that the device may fail to meet the user's needs.

In view of the problem mentioned above, an object of the present invention is to provide another option for a user through outputting selection information that is whether or not the duplex printing process is performed by using another sheet stored in another sheet tray and that is to be selected by the user when the thickness of the sheet fed from the sheet tray is equal to or more than the threshold value.

SUMMARY

In order to solve the above problems, the image forming device includes a first medium container, which contains a first printing medium; a second medium container, which contains a second printing medium; a medium feeder for feeding one of the first and second media from one of the first and second medium containers; a special process unit that performs a special process on the first printing medium fed by the medium feeder when image data, which includes instruction information instructing the special process, is received; a detector that detects a characteristic of the first printing medium; a special process capability determination unit for determining whether or not the special process instructed by the instruction information can be performed based on the characteristic; and a control unit that ejects the printing medium and that causes the second medium to be fed from the second medium container when the special process capability determination unit determines that the special process cannot be performed. In the following embodiments, the medium container is performed as sheet trays. The printing medium is performed as a sheet or OHP. The medium feeders are as sheet feeding rollers. The special process unit is configured with a special process instruction status determination unit, or the detector is performed by an inlet sensor.

Also, an image forming method of the application includes receiving image data, wherein the image data includes instruction information for instructing that a special process be performed in addition to image formation; feeding a sheet from one of first and second medium containers to a conveying path; detecting a characteristic of the sheet; determining whether or not the sheet qualifies for the special process based on the characteristic. If the sheet qualifies for the special process, the method includes performing the special process on the sheet. If the sheet fails to qualify for the special process, the method includes presenting a list of options on a display, and one of the options corresponds to an instruction for the image forming device to feed a sheet from the other of the first and second medium containers for the image forming process.

With the above configuration, the user's expecting duplex printing are realized

BRIEF DESCRIPTION OF THE DRAWINGS

FIGS. 8A, 8B and 8C are explanatory diagrams of a configuration of a sheet thickness information memory unit 108 of the second embodiment.

FIG. 9 is an explanatory diagram of a configuration of a threshold value information memory unit 105*a* of the second embodiment.

DETAILED DESCRIPTION

An embodiment according to the present invention is explained in detail below with reference to drawings. In the embodiment, a printer that is an example of an image forming device is explained.

Figure 2:
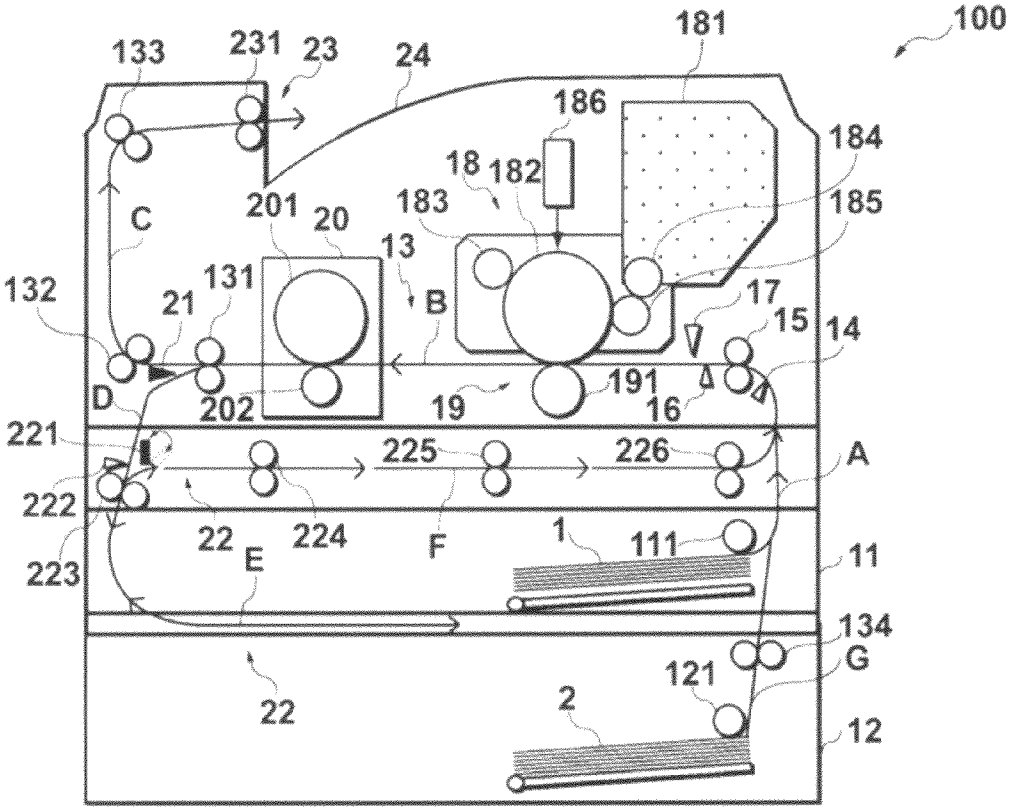
FIG. 2 is a schematic view of the printer 100 of the first embodiment.

(First Embodiment) As shown in FIG. 2, the printer 100 has the following structures: a first sheet tray 11 that loads and holds a sheet 1; a second sheet tray 12 that loads and holds another sheet 2; a conveying unit 13 having conveying paths and conveying rollers; an inlet sensor 14; a pair of registration rollers 15; a writing sensor 16; a sheet thickness sensor 17; an image forming unit 18; an image transferring unit 19; an image fusing unit 20; a duplex separator 21; an inversion unit 22; an eject unit 23; and a stacker unit 24 in which an ejected sheet from the printer 100 is loaded. The printer 100 in the first embodiment is configured with two sheet trays, the first sheet tray 11 and the second sheet tray 12. However, the present invention is not limited to the printer 100 with two sheet trays and can be applied to a printer with more than two sheet trays.

Figure 1:
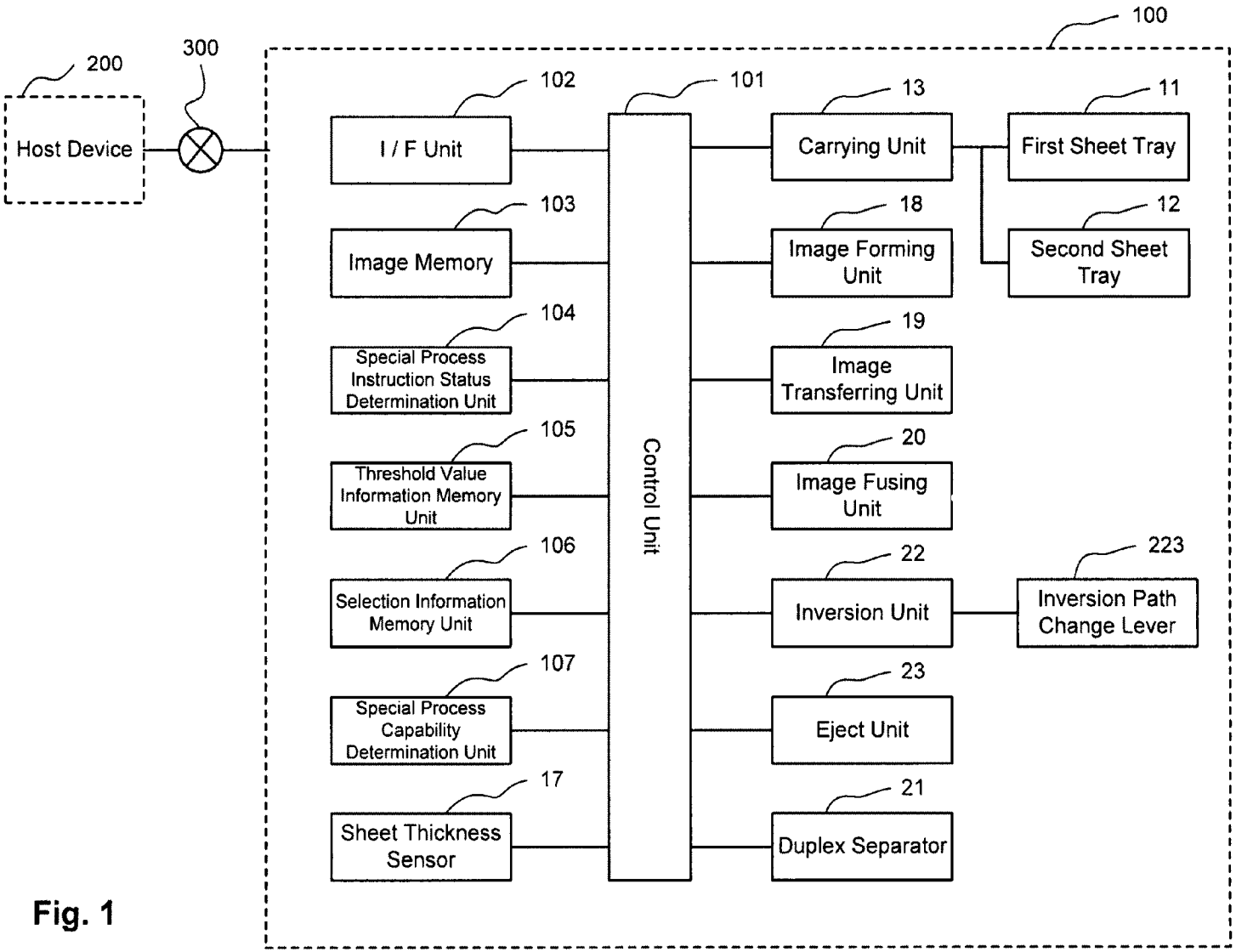
FIG. 1 is a block diagram of a control configuration of a printer 100 of a first embodiment.

The printer 100 connects a host device 200, such as a personal computer (PC) operated by a user, through a network 300 (see FIG. 1). When the printer 100 receives print data from the host device 200, the printer 100 converts the print data to image data that is usable for a print process through a rasterize transformation unit, which is not shown. The printer 100 performs the image forming process based on the image data. In this embodiment, the printer 100 performs the image forming process based on the print data received from the host device 200. However, the present invention is not limited to the structure discussed above and can be applied to a printer that performs the image forming process based on image data created by scanning a manuscript through a reader (scanner) that is not shown.

As shown in FIG. 2, the first sheet tray 11, which loads and holds a sheet 1, and the second sheet tray 12, which loads and holds another sheet 2, are detachable from the lower part of the printer 100.

A first sheet feeding roller 111 that feeds the sheet 1 loaded in the tray one by one from the top is located at the feeding side of the first sheet tray 11. The first sheet feeding roller 111 is located and arranged to press the top of the sheet 1 loaded in the first sheet tray 11. When the first sheet feeding roller 111 is driven to rotate by a drive unit, which is not shown and which is driven based on control of a control unit 101 shown in FIG. 1, the first sheet feeding roller 111 feeds the sheet 1 from the tray based on the rotation. The sheet 1 fed by the first sheet feeding roller 111 is supplied to a conveying unit 13 (conveying path A).

A second sheet feeding roller 121 that feeds the sheet 2 loaded in the tray one by one from the top is located at the feeding side of the second sheet tray 12. The second sheet feeding roller 121 is located and arranged to press the top of the sheet 2 loaded in the second sheet tray 12. When the second sheet feeding roller 121 is driven to rotate by the drive unit, which is driven based on control of the control unit 101, the second sheet feeding roller 121 feeds the sheet 2 from the tray based on the rotation. The sheet 2 fed by the second sheet feeding roller 121 is supplied to the conveying path A through a conveying path G.

As shown in FIG. 2, the conveying unit 13 has the conveying path A, a conveying path B, a pair of conveying rollers 131, a conveying path C, a pair of conveying rollers 132, a pair of conveying rollers 133, the conveying path G, and a pair of conveying rollers 134. Each pair of conveying rollers is driven to rotate by a drive unit, which is not shown. The sheet 1 or another sheet 2 is carried along the conveying paths.

A leading edge of the fed sheet abuts a nipping part that is formed between rollers of a pair of registration rollers 15, which is suspended. This operation corrects a misalignment of the sheet.

The inlet sensor 14 is used to detect the timing for driving the pair of registration rollers 15, which is suspended, through controlling the drive unit by the control unit 101. When the inlet sensor 14 detects the leading edge of the sheet, the inlet sensor generates an inlet detection signal and sends it to the control unit 101.

When the control unit 101 receives the inlet detection signal, the control unit 101 controls the drive unit and rotates the pair of registration rollers 15. Therefore, the aligned sheet is carried toward the writing sensor 16 along the conveying path B by the pair of registration rollers 15 that started to rotate.

The writing sensor 16 is used to adjust the positions between the starting position for forming a toner image on a photoreceptor drum 182 and the starting position for writing the toner image on the sheet in order to form the toner image that is formed on the photoreceptor drum 182 to the sheet. When the writing sensor 16 detects the leading edge of the sheet that is carried from the pair of registration rollers 15, the writing sensor 16 generates a writing detection signal and sends it to the control unit 101. When the control unit 101 receives the writing detection signal, the control unit 101 instructs an exposure head 186 (see FIG. 2) to perform the exposure.

The sheet that passes the writing sensor 16 is carried to the sheet thickness sensor 17 along the conveying path B.

The sheet thickness sensor 17 has a light emitting part that emits light to the sheet and a light receiving part that receive reflected light from the sheet. The sheet thickness sensor 17 is a displacement sensor that compares a frequency of the received reflected light and a frequency of a reflected light that results when light is irradiated on a standard sheet. The frequency information is stored in a buffer memory that is not illustrated. The sheet thickness sensor further calculates the thickness of the sheet. When the sheet thickness sensor 17 is turned on by the control unit 101, the sheet thickness sensor calculates the thickness of the sheet that is carried to the image forming unit 18 along the conveying path B. When the sheet thickness sensor 17 calculates the thickness, the sheet thickness sensor 17 generates a thickness detection signal showing the thickness of the sheet and sends the signal to the control unit 101. The sheet thickness sensor 17 is used to detect the thickness of a first page corresponding to each data image. After the sheet thickness sensor 17 detects the thickness, the sheet thickness sensor 17 is turned off by a control of the control unit 101. The control of the control unit 101 based on the thickness detection signal is explained in detail when the control configuration is discussed below. The sheet thickness sensor is a detector to detect characteristics (sheet thickness) of the sheet 1 or another sheet 2.

The image forming unit 18 is a structure to form a toner image in black color (K). As shown in FIG. 2, the image forming unit 18 has a toner cartridge 181 storing black color toner, the photoreceptor drum 182, a charge roller 183, a supply roller 184, a developing roller 185, and the exposure head 186. In this embodiment, the image forming unit 18 forms only the toner image in black color. However, the present invention is not limited to the structure discussed above and can be applied to a printer (full color) that forms toner images in black color (K), yellow color (Y), magenta color (M) and cyan color (C).

The photoreceptor drum 182 is an electrostatic latent image carrier in which a toner image is formed on the surface.

The charge roller 183 is a charger to uniformly charge the surface of the photoreceptor drum 182 when the photoreceptor drum 182 rotates.

The exposure head 186 is configured with an light emitting diode (LED) allay and is a exposing device to form an electrostatic latent image that corresponds to image data on the surface of the charged photoreceptor drum 182 based on the instruction of the exposure from the control unit 101.

The supply roller 184 is used to supply toner in black color stored in the toner cartridge 181 to the developing roller 185.

When the electrostatic latent image is formed on the surface of the photoreceptor drum 182, the toner in black color supplied from the toner cartridge 181 adheres to the surface of the developing roller 185 through the supply roller 184 based on the control by the control unit 101. Then, the toner is formed in the uniform thickness by a layer forming blade that is not shown and is developed in the electrostatic latent image on the drum. As a result, the toner image in black color that corresponds to the electrostatic latent image is formed on the surface of the photoreceptor drum 182.

The image transferring unit 19 is configured with a transferring roller 191 that locates in an opposite position to the photoreceptor drum 182 through a conveying belt that is not shown as the conveying path B.

The image forming unit 18, the image transferring unit 19, and the conveying belt are driven synchronically by the control of the control unit 101. First, a sheet that is adhered to the conveying belt by electrostatic adsorption and that is carried in accordance with the rotatable running of the belt is carried to the position between the photoreceptor drum 182 and the transferring roller 191. Because a transferring voltage is applied to the transferring roller 191 by the control of the control unit 101, the toner image in black color that is formed on the surface of the photoreceptor drum 182 is transferred on the surface of the sheet. The Sheet in which the toner image in black color is transferred is further carried to the image fusing unit 20 in accordance with the running of the conveying belt.

Transferring residue toner remaining on the surface of the photoreceptor drum 182 is scraped off by, for example, a cleaning blade that is not shown and is collected into a waste toner container.

The image fusing unit 20 is a structure to fuse the toner image transferred on the sheet to the sheet. As shown in FIG. 2, the image fusing unit 20 has a heat application roller 201, a pressure application roller 202 that locate to contact the heat application roller 201 through a conveying belt. The heat application roller 201 has a heater that is not shown inside the roller to heat the heat application roller 201.

The sheet in which the toner image is transferred is carried to sandwich between the heat application roller 201 and the pressure application roller 202. The transferred toner image in black color is fused. Then, the sheet is carried to a pair of transferring rollers 131.

The duplex separator 21 rotates from the initial position to the lower direction by the control of the control unit 101 at the time of the duplex printing process and changes over a conveying path of the sheet in which the image fusing process is finished on one side from a direction of the eject unit 23 (conveying path C) to a direction of the inversion unit 22 (conveying path D). When the duplex separator 21 rotates to the lower direction by the control of the control unit 101, the duplex separator 21 rotates to the upper direction and returns to the initial position after a certain time elapses.

When the duplex separator 21 is in the initial position, the sheet that is carried between the pair of transferring rollers 131 is diverted in the upper direction (conveying path C) of the device where the eject unit 23 is located.

The sheet that is diverted in the upper direction of the device is ejected to the eject unit 23 along the conveying path C by the rotation of pairs of transferring rollers 132 and 133.

As shown in FIG. 2, the eject unit 23 has a pair of ejecting rollers 231 and ejects the sheet for which the print process is finished to the stacker unit 24 outside the device.

On the other hand, when the duplex separator 21 rotates in the lower direction, the sheet is diverted in the lower direction (conveying path D) of the device where the inversion unit 22 is located.

The inversion unit 22 is used at the time of the duplex printing process for turning the sheet reverse-side up after the print process for one side of the sheet is finished. As shown in FIG. 2, the inversion unit 22 has the conveying path D, an inversion path change lever 221, a change position sensor 222, a pair of inversion rollers 223, a conveying path E, a conveying path F, and a plurality of pairs of conveying rollers 224, 225, and 226. The inversion unit 22 is a special process unit for performing the duplex printing process.

As shown in FIG. 2, the inversion path change lever 221 rotates in a clockwise direction from the initial position, and the sheet, which is carried from the conveying path D to the conveying path E, is carried in a direction from the conveying path E to the conveying path F. When the inversion path lever does not rotate and is in the initial position, the sheet, which is carried along the conveying path D, is carried to a direction of the conveying path E by the pair of inversion rollers 223 that is rotated by drive from the drive unit based on the control of the control unit 101.

The change position sensor 222 locates in the vicinity of the inversion path change lever 221 as shown in FIG. 2 and is used to detect the change timing of the rotation of the pair of inversion rollers 223 from the forward direction to the backward direction. Namely, when the change position sensor 222 detects the trailing edge of the sheet that is carried by the pair of inversion rollers 223, the change position sensor 222 creates a trailing edge detection signal and sends it to the control unit 101.

When the control unit 101 receives the trailing edge signal, the control unit 101 stops the rotation of the pair of inversion rollers 223 by controlling the drive unit and rotates the inversion path change lever 221 in the clockwise direction. As a result, the pair of inversion rollers 223 stops while holding the trailing edge of the sheet.

The control unit 101 rotates the pair of inversion rollers 223 in the reverse direction by controlling the drive unit after a certain time elapses. When the pair of inversion rollers 223 starts to rotate in the reverse direction, the sheet, which is suspended and is held by the pair of inversion rollers 223, is carried to the conveying path F because the inversion path change lever 221 has rotated in the clockwise direction. As shown in FIG. 2, the sheet, which is carried to the conveying path F, is carried to the conveying path B while the sheet is held by a plurality of pairs of transferring rollers 224, 225, and 226 that rotate based on the control of the drive unit by the control unit 101.

The sheet is carried to the conveying path B direction. When the leading edge of the sheet is detected by the inlet sensor 14 again, the reverse-side, or second side, of the sheet is the up-side. Then, printing is performed on the reverse side of the sheet through the image forming unit 18 and the image fusing unit 20 as was performed on the first side of the sheet. After the print process for the reverse side of the sheet is finished, the sheet passes the duplex separator 21 that is located in the initial position, is carried along the conveying path C to the eject unit 23 direction, ejects from the eject unit 23 to outside of the device, and is loaded on the stacker unit 24.

Control configurations that are features of the printer 100 of the first embodiment according to the present invention are explained below. The printer 100 has the following structures as shown in FIG. 1: the control unit 101 that controls each of units in the printer 100 and controls overall of the printer 100; an inter face (I/F) unit 102 that communicates with the host device 200; an image memory 103; a special process instruction status determination unit 104; a threshold value information memory unit 105; a selection information memory unit 106; and a special process capability determination unit 107.

When the control unit 101 receives print data from the host device 200 through the I/F unit 102, the control unit 101 converts the print data to image data through a rasterize transformation unit, which is not shown and is in the printer 100. In this embodiment, the print data contains print instruction information indicating one-side printing or duplex printing, sheet size information indicating a size of paper, such as A4, and sheet tray information indicating automatic sheet feeding (without sheet tray assignment). The image data keeps the print instruction information, the sheet size information, and the sheet tray information that are contained in the print data.

The image memory 103 is a memory unit to store the image data based on the control of the control unit 101. In this embodiment, the image memory 103 stores the image data that is obtained through the rasterize transformation of the print data from the host device 200. However, the present invention is not limited to the structure discussed above, and the image memory 103 can store the image data that is obtained by scanning a manuscript through the reader (scanner).

After the image data is stored in the image memory 103, the control unit 101 controls the drive unit to rotate the photoreceptor drum 182 and, at the same time, instructs the special process instruction status determination unit 104 to determine existence or non-existence of the duplex printing instruction.

The special process instruction status determination unit 104 determines existence or non-existence of the duplex printing instruction based on the print instruction information contained in the image data. When the print instruction information indicates the duplex printing, the special process instruction status determination unit 104 determines that the duplex printing instruction exists.

On the other hand, when the print instruction information indicates the one-side printing, the special process instruction status determination unit 104 determines that the duplex printing instruction does not exist.

When the special process instruction status determination unit 104 determines that the duplex printing instruction exists, the control unit 101 turns on the sheet thickness sensor 17. In this embodiment, when the printer 100 performs the print process based on the sheet tray information (automatic sheet feeding), the control unit 101 rotates the first sheet feeding roller 111 by the control of the drive unit based on a program that is set in a memory (not shown) in advance. As a result, the first sheet feeding roller 111 that starts to rotate feeds the top of the sheet 1 loaded in the first sheet tray 11 to the conveying path A.

On the other hand, when the special process instruction status determination unit 104 determines that the duplex printing instruction does not exist, the control unit 101 does not turn on the sheet thickness sensor 17 and performs the print process on only one side of the sheet 1 based on the image data. The sheet 1 in which the print process is performed on only one side is ejected from the eject unit 23 and is loaded on the stacker unit 24.

When the sheet 1, which is carried to the conveying path A, passes the sheet thickness sensor 17, the sheet thickness sensor 17 calculates the thickness of the sheet 1 and sends the thickness detection signal to the control unit 101 as discussed above.

When the control unit 101 receives the thickness detection signal, the control unit 101 instructs the special process capability determination unit 107 to determine whether duplex printing can be performed and transfers the thickness detection signal to the special process capability determination unit 107.

The threshold value information memory unit 105 stores the threshold information showing the predetermined threshold value that indicates the sheet thickness at or above which duplex printing cannot be performed. In this embodiment, the threshold value is set to 160 μm. This threshold value is obtained through experimentation with the printer 100 in advance, which determined at what sheet thicknesses two hundred sheets could be continuously printed with the duplex printing.

The selection information memory unit 106 stores predetermined print selection information such as "change to one-side printing process," "perform duplex printing process with another sheet," and "stop print process," one of which a user selects when the duplex printing cannot be performed. The print selection information is explained in detail when FIG. 3 is explained below.

The special process capability determination unit 107 determines whether or not duplex printing is possible based on the thickness determination signal. When the special process capability determination unit 107 receives the thickness determination signal, the special process capability determination unit 107 compares the threshold value (160 μm) stored in the threshold value information memory unit 105 with the sheet thickness shown in the thickness determination signal. When the sheet thickness is less than the threshold value (160 μm), the special process capability determination unit 107 determines that duplex printing can be performed. When the special process capability determination unit 107 determines that duplex printing can be performed, the control unit 101 controls the duplex printing as discussed above.

On the other hand, when the sheet thickness is equal to or more than the threshold value (160 μm), the special process capability determination unit 107 determines that duplex printing cannot be performed. When the special process capability determination unit 107 determines that the duplex printing cannot be performed, the control unit 101 sends the print selection information, which is stored in the selection information memory unit 106, to the host device 200 and controls that the sheet is carried between the image forming unit 18 and the image fusing unit 20 (conveying path B) without the print process. Then, the sheet in which the print process is not performed is ejected from the eject unit 23 to outside of the device through the rotation of the pair of ejecting rollers 231 and is loaded on the stacker unit 24. In this embodiment, the control unit 101 sends the print selection information to the host device 200 in order to show the information on a display (not shown) of the host device 200. However, the present invention is not limited to the structure discussed above and can be applied to a structure in which the information is shown on a display (not shown) of the printer 100. When the print selection information is sent to the host device 200, the control unit 101 acts as the special process confirmation unit outputting the information.

Figure 3:
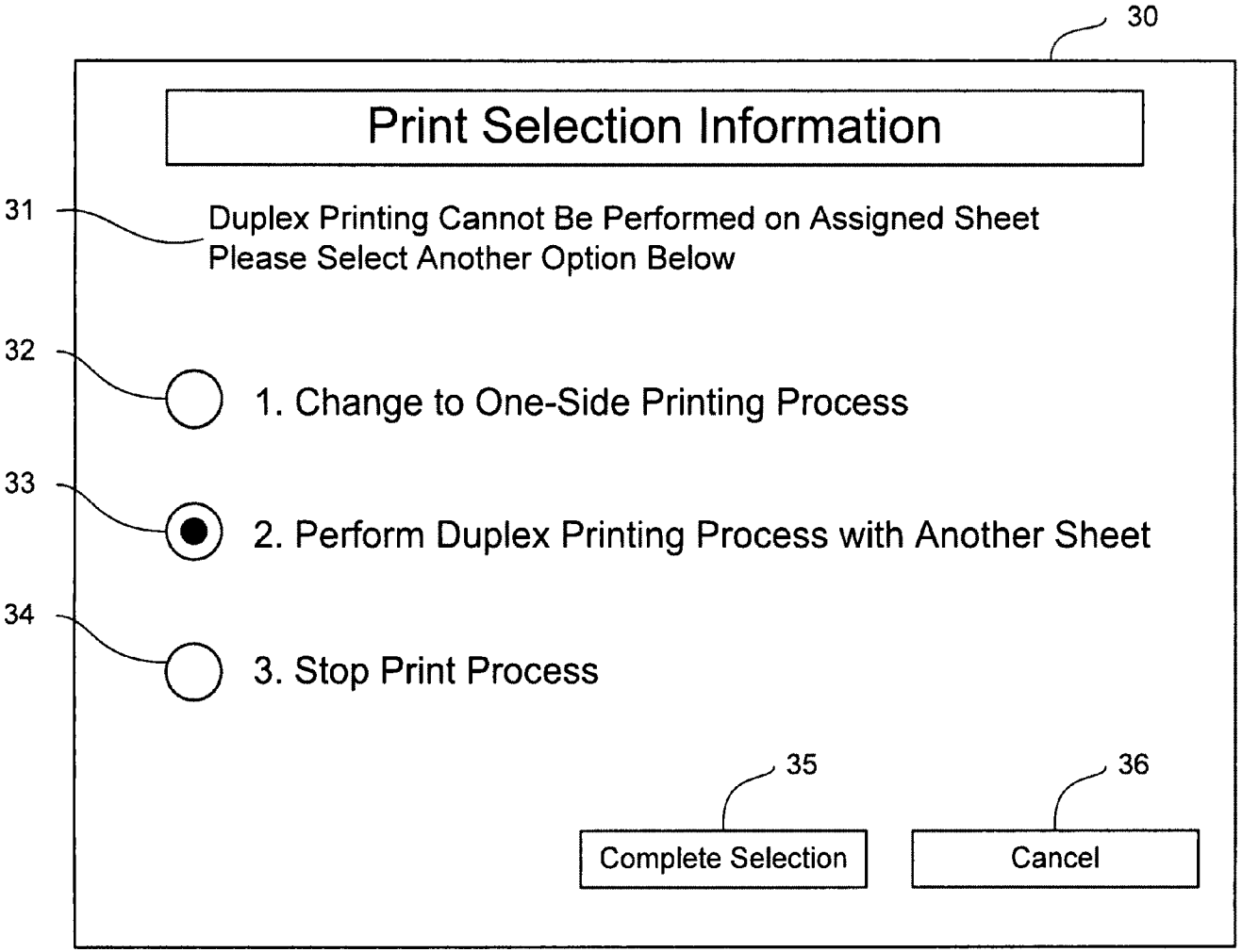
FIG. 3 is a schematic view of a display of print selection information of the first embodiment.

As shown in FIG. 3 the host device 200 is a PC operated by a user and generates print data by using application software stored in a memory (not shown) in advance of the host device 200. The host device 200 also has a display (not shown) to show information that is sent from the printer 100 and a input unit (not shown) that has an input button. Namely, when the host device 200 receives the print selection information from the printer 100, the host device 200 shows the information on a display unit 30 in FIG. 3.

As shown in FIG. 3, the form 30 has a message 31 notifying that the duplex printing process cannot be performed on the sheet assigned by a user, selection buttons 32, 33, and 34 corresponding to three options, "1. Change to One-Side printing Process," "2. Perform Duplex Printing Process with Another Sheet," "3. Stop Print Process," respectively, a "Complete Selection" button 35, and a "Cancel" button 36.

When the user refers the form showing on the display unit 30 of the host device 200, selects the selection button 32 through an input unit (not shown) corresponding to "1. Change to One-Side Printing Process," and pushes the "Complete Selection" button 35, a control unit (not shown) of the host device 200 generates response information containing the "Change to One-Side Printing Process" option and sends the information to the printer 100.

Alternatively, when the user selects the selection button 33 corresponding to "2. Perform. Duplex Printing Process with Another Sheet," and pushes the "Complete Selection" button 35, a control unit generates response information containing the "Perform Duplex Printing Process with Another Sheet" option and sends the information to the printer 100.

Further alternatively, when the user selects the selection button 34 corresponding to "3. Stop Print Process," and pushes the "Complete Selection" button 35, a control unit generates response information containing the "Stop Print Process" option and sends the information to the printer 100.

When the control unit 101 of the printer 100 receives the response information from the host device 200, and when the response information shows the "Change to One-Side Printing Process" option, the control unit 101 rotates the first sheet feeding roller 111 by driving the drive unit and feeds the top of the sheet 1 loaded in the first sheet tray 11 to the conveying path A. Then, the one-side printing is performed on the sheet 1 based on image data stored in the image memory 103.

Alternatively, when the response information shows "Perform Duplex Printing Process with Another Sheet," the control unit 101 rotates the second sheet feeding roller 121 by driving the drive unit and feeds the top of the sheet 2 loaded in the second sheet tray 12 to the conveying path A. And then, the sheet thickness sensor 17, which is turned on by the control unit 101, calculates the thickness of the sheet 2. When the thickness of the sheet 2 is less than the predetermined threshold value (160 μm), the control unit 101 determines that the duplex printing can be performed and performs the duplex printing process on the sheet 2. In this embodiment, because the printer 100 is able to perform the duplex printing, the sheet loaded and held in at least one of the first sheet tray 11 and the second sheet tray 12 should have the thickness that permits duplex printing.

Further alternatively, when the response information shows "Stop Print Process," the control unit 101 deletes the image data stored in the image memory 103 by using an image delete unit (not shown). Then, the printer 100 is in a print data waiting state by the control of the control unit 101.

Figure 4:
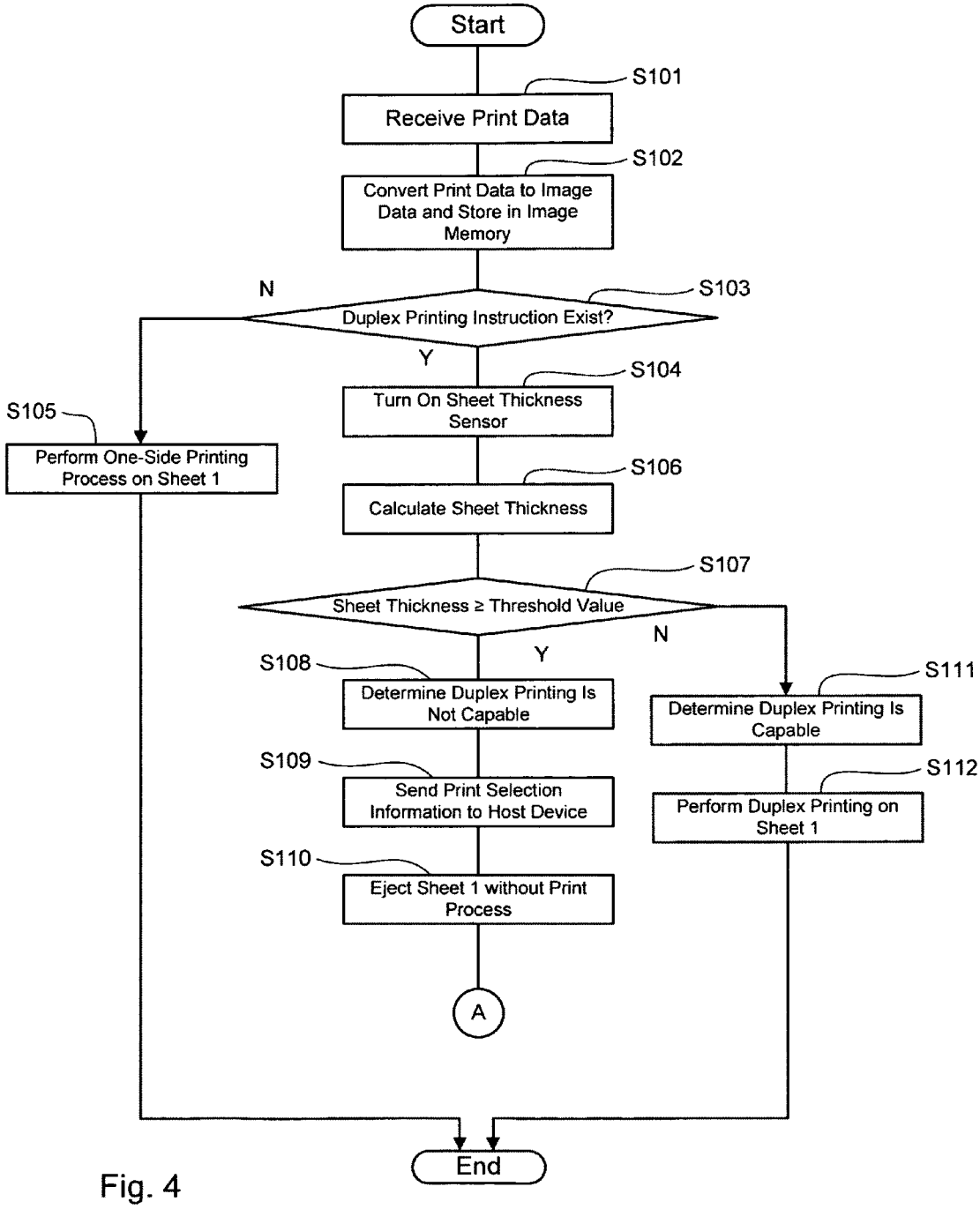
FIG. 4 is a flow diagram of operation of the printer 100 of the first embodiment.
Figure 5:
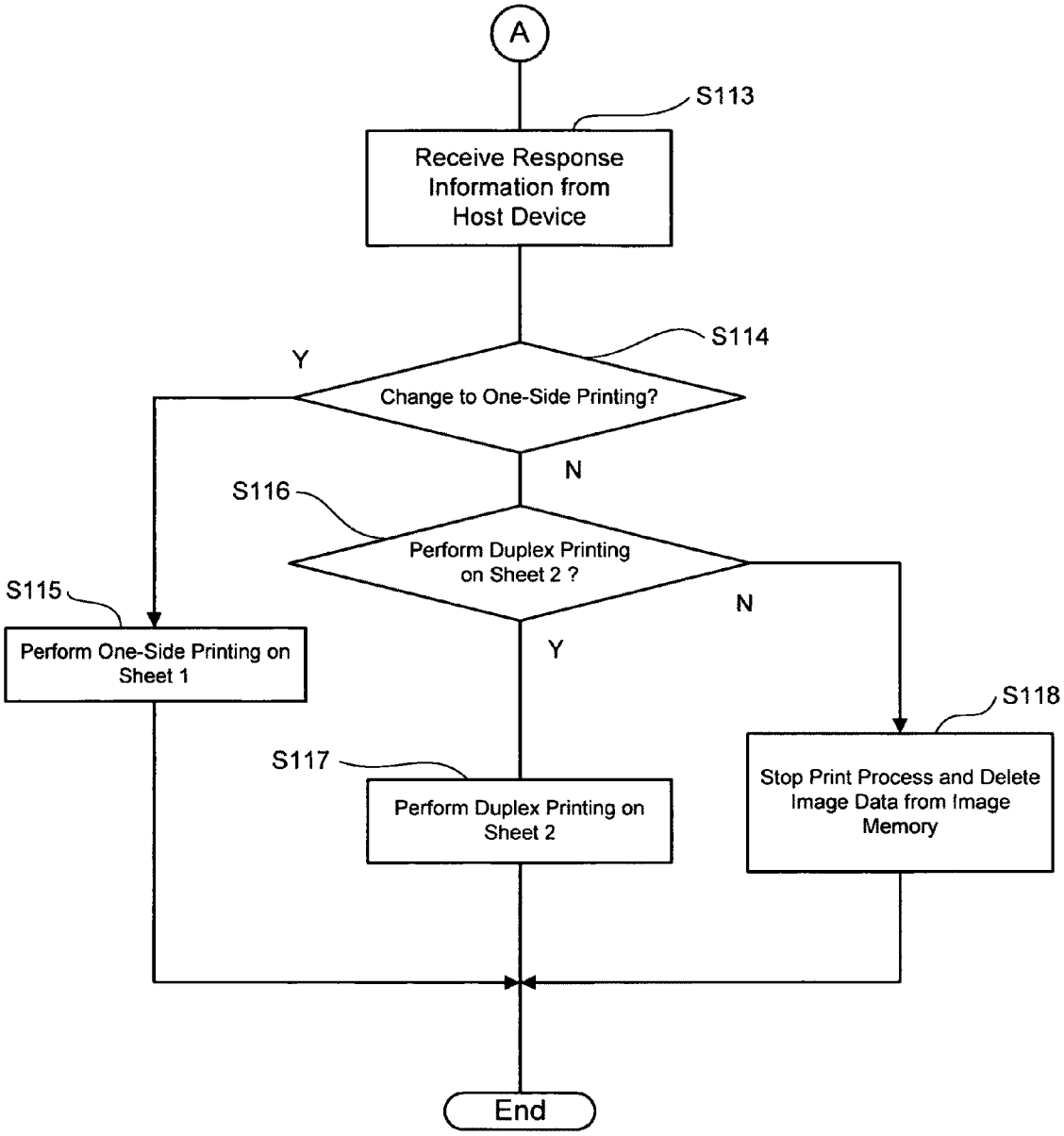
FIG. 5 is a flow diagram of operation of the printer 100 of the first embodiment.

FIGS. 4 and 5 are flow diagrams of operation of the printer 100 of the first embodiment according to the present invention. Operation of the printer 100 of the first embodiment according to the present invention is explained with reference to the flow diagrams in FIGS. 4 and 5. The first sheet tray 11 loads and holds the sheet 1 that has the following characteristics: the quality of a sheet is normal (normal paper); the size of a sheet is A4; and the thickness of a sheet is 170 μm. Similarly, the second sheet tray 12 loads and holds the sheet 2 that has the following characteristics: the quality of a sheet is normal (normal paper); the size of a sheet is A4; and the thickness of a sheet is 80 μm.

When the control unit 101 of the printer 100 receives print data from the host device 200 through the I/F unit 102 (S101), the control unit 101 converts the print data to image data through a rasterize transformation unit that is not shown and is in the printer 100. The print data contains print instruction information showing a one-side printing or a duplex printing, sheet size information showing a size of paper, such as A4, and sheet tray information showing automatic sheet feeding (without sheet tray assignment). The image data keeps the print instruction information, the sheet size information, and the sheet tray information that are contained in the print data.

After the image data is stored in the image memory 103 (S102), the control unit 101 controls the drive unit to rotate the photoreceptor drum 182 and, at the same time, instructs the special process instruction status determination unit 104 to determine existence or non-existence of the duplex printing instruction.

When the special process instruction status determination unit 104 receives the instruction containing existence or non-existence of the duplex printing instruction, and when the print instruction information indicates the duplex printing, the special process instruction status determination unit 104 determines that the duplex printing instruction exists (S103).

On the other hand, when the print instruction information indicates the one-side printing, the special process instruction status determination unit 104 determines that the duplex printing instruction does not exist.

When the special process instruction status determination unit 104 determines that the duplex printing instruction exists, the control unit 101 turns on the sheet thickness sensor 17 (S104). When the printer 100 performs the print process based on the sheet tray information (automatic sheet feeding), the control unit 101 rotate the first sheet feeding roller 111 by the control of the drive unit based on a program that is set in a memory in advance that is not shown. As a result, the first sheet feeding roller 111 that starts to rotate feeds the top of the sheet 1 loaded in the first sheet tray 11 to the conveying path A.

On the other hand, when the special process instruction status determination unit 104 determines that the duplex printing instruction does not exist, the control unit 101 does not turn on the sheet thickness sensor 17 and performs the print process on only one side of the sheet 1 based on the image data (S105). The sheet 1 in which the print process is performed on only one side is ejected from the eject unit 23 and is loaded on the stacker unit 24.

When the sheet 1, which is carried to the conveying path A, passes the sheet thickness sensor 17, the sheet thickness sensor 17 calculates the thickness (170 μm) of the sheet 1 (S106) and sends the thickness detection signal to the control unit 101.

When the control unit 101 receives the thickness detection signal, the control unit 101 instructs the special process capability determination unit 107 to determine capability of the duplex printing and transfers the thickness detection signal to the special process capability determination unit 107.

When the special process capability determination unit 107 receives the thickness determination signal, the special process capability determination unit 107 compares the threshold value (160 μm) stored in the threshold value information memory unit 105 with the sheet thickness (170 μm) shown in the thickness determination signal. Because the sheet thickness (170 μm) is more than the threshold value (160 μm) (S107), the special process capability determination unit 107 determines that duplex printing cannot be performed (S108). When the special process capability determination unit 107 determines that the duplex printing cannot be performed, the control unit 101 sends the print selection information, which is stored in the selection information memory unit 106, to the host device 200 (S109) and controls that the sheet is carried between the image forming unit 18 and the image fusing unit 20 (conveying path B) without the print process. Then, the sheet in which the print process is not performed is ejected from the eject unit 23 to outside of the device through the rotation of the pair of ejecting rollers 231 and is loaded on the stacker unit 24 (S110).

On the other hand, when the sheet thickness is less than the threshold value (160 μm), the special process capability determination unit 107 determines that the duplex printing can be performed (S111). When the special process capability determination unit 107 determines that the duplex printing can be performed, the control unit 101 controls the duplex printing (S112).

When the control unit of the host device 200 receives the print selection information from the printer 100, the control unit of the host device 200 shows the information on a display unit 30 as shown in FIG. 3.

When the user refers the form appearing on the display unit 30 of the host device 200, selects the selection button 32 through an input unit (not shown) corresponding to "1. Change to One-Side Printing Process," and pushes the "Complete Selection" button 35, the control unit of the host device 200 generates response information containing the "Change to One-Side Printing Process" option and sends the information to the printer 100.

Alternatively, when the user selects the selection button 33 corresponding to "2. Perform Duplex Printing Process with Another Sheet," and pushes the "Complete Selection" button 35, the control unit of the host device 200 generates response information containing the "Perform Duplex Printing Process with Another Sheet" option and sends the information to the printer 100.

Further alternatively, when the user selects the selection button 34 corresponding to "3. Stop Print Process," and pushes the "Complete Selection" button 35, the control unit of the host device 200 generates response information containing the "Stop Print Process" option and sends the information to the printer 100.

When the control unit 101 of the printer 100 receives the response information from the host device 200 (S113), and when the response information shows the "Change to One-Side Printing Process" option (S114), the control unit 101 rotates the first sheet feeding roller 111 by driving the drive unit and feeds the top of the sheet 1 loaded in the first sheet tray 11 to the conveying path A. Then, the one-side printing is performed on the sheet 1 based on image data stored in the image memory 103 (S115). The sheet 1 in which the one-side printing process is finished is ejected from the eject unit 23 and is loaded on the stacker unit 24.

Alternatively, when the response information shows "Perform Duplex Printing Process with Another Sheet" (S116), the control unit 101 rotates the second sheet feeding roller 121 by driving the drive unit and feeds the top of the sheet 2 loaded in the second sheet tray 12 to the conveying path A. And then, the sheet thickness sensor 17, which is turned on by the control unit 101, calculates the thickness (80 μm) of the sheet 2. Because the thickness (80 μm) of the sheet 2 is less than the predetermined threshold value (160 μm), the control unit 101 determines that the duplex printing can be performed and performs the duplex printing process on the sheet 2 (S117). The sheet 2 in which the duplex printing process is finished is ejected from the eject unit 23 and is loaded on the stacker unit 24.

Further alternatively, when the response information shows "Stop Print Process," the control unit 101 stops the printing process and deletes the image data stored in the image memory 103 by using an image delete unit (not shown) (S118). Then, the printer 100 is in a print data waiting state by the control of the control unit 101.

When the duplex printing is performed in the printer 100 of the first embodiment, and when the thickness of the sheet 1 is equal to or more than the threshold value, which corresponds that the duplex printing cannot be performed, the printer 100 sends the print selection information to the host device 200. The user uses the print selection information for deciding whether or not the duplex printing is performed on another sheet 2. The print selection information can be shown in a display unit in the printer 100. Therefore, the first embodiment can provide another option of performing the duplex printing on another sheet 2 for the user.

Figure 7:
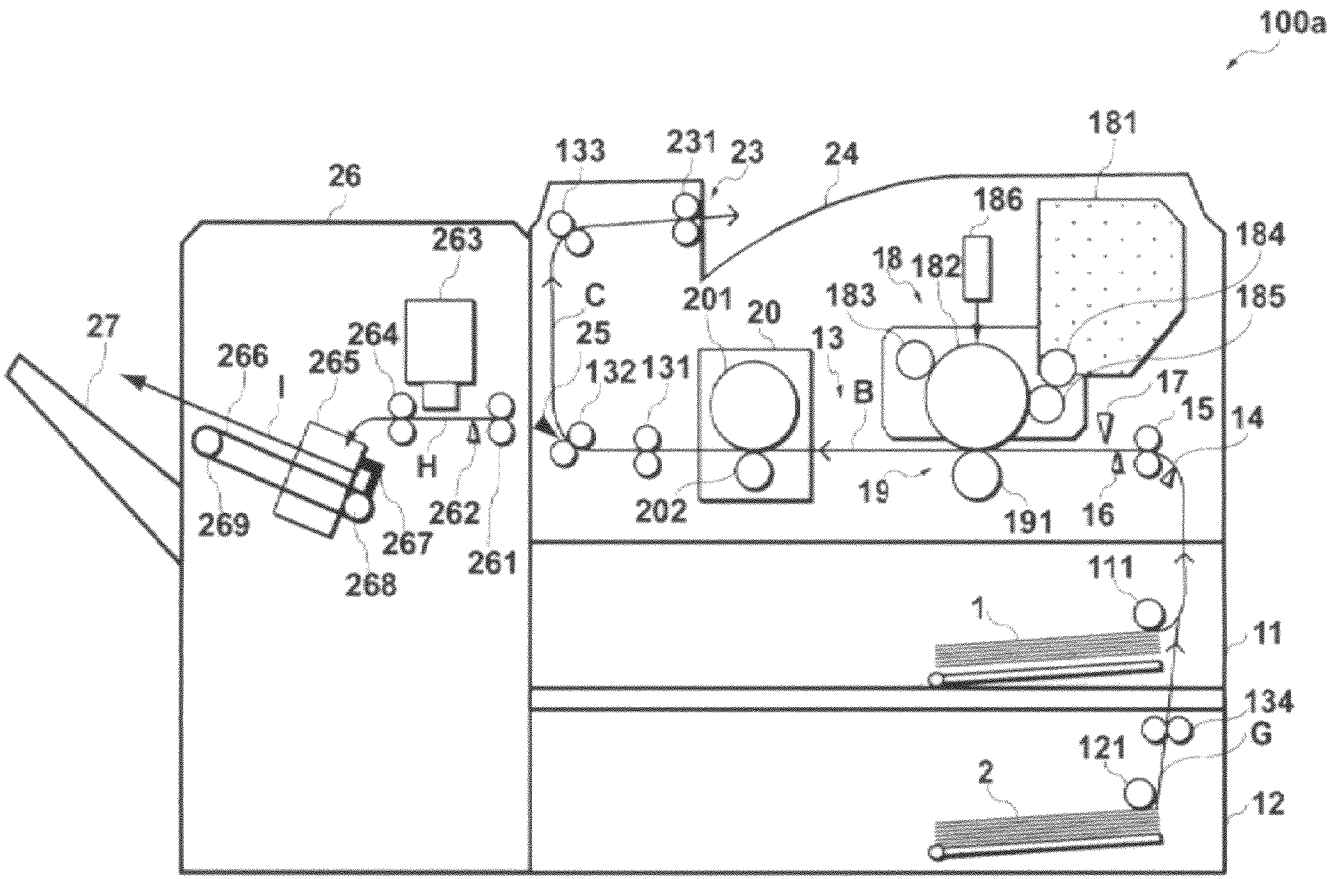
FIG. 7 is a schematic view of the printer 100*a* of the second embodiment.

(Second Embodiment) A printer 100*a* of a second embodiment according to the present invention has a structure that enables to perform one-side printing process in the printer 100 of the first embodiment (without duplex separator 21 and inversion unit 22) and structures that enable to perform a hole punch process and a staple process (see FIG. 7). In this embodiment, the same reference numerals are used for the same structures of the first embodiment, and detailed explanation for them is omitted.

As shown in FIG. 7, The printer 100*a* has the following structures as shown in FIG. 7: a first sheet tray 11 that loads and holds a sheet 1; a second sheet tray 12 that loads and holds another sheet 2; a conveying unit 13 having each of conveying paths and each of conveying rollers; an inlet sensor 14; a pair of registration rollers 15; a writing sensor 16; a sheet thickness sensor 17; an image forming unit 18; an image transferring unit 19; an image fusing unit 20; an eject unit 23; a stacker unit 24; an eject destination change separator 25; a post-process unit 26 in which the post-processes (hole punch process and staple process) are performed; and a post-process stacker unit 27 in which a sheet that performed a post-process is loaded. The printer 100*a* in this embodiment is configured with two sheet trays, a first sheet tray 11 and a second sheet tray 12. However, the present invention is not limited to the printer 100*a* with two sheet trays and can be applied to a printer with a plurality of sheet trays.

The eject destination change separator 25 rotates from the initial position to the lower direction by the control of the control unit 101*a* at the time of the hole punch process or the staple process and changes over a conveying path of the sheet 1 or another sheet 2 from a direction of the eject unit 23 (conveying path C) to a direction of the post-process unit 26 (conveying path H). When the eject destination change separator 25 rotates to the upper direction and returns to the initial position by the control of the control unit 101*a* after a print process based on image data stored in an image memory is finished.

When the eject destination change separator 25 does not rotate to the lower direction and is in the initial position, the sheet that is carried between the pair of transferring rollers 131 is forwarded to the upper direction (conveying path C) of the device where the eject unit 23 locates.

On the other hand, when the eject destination change separator 25 rotates to the lower direction, the sheet is forwarded to the post-process unit 26 direction (conveying path H).

The sheet that is forwarded to the upper direction of the device is ejected to the eject unit 23 along the conveying path C by the rotation of pairs of transferring rollers 132 and 133.

The post-process unit 26 is used for post-processes (hole punch process and staple process) and performs the hole punch process or the staple process for the sheet. As shown in FIG. 7, the post-process unit 26 has a pair of conveying rollers 261, an intake sensor 262, a hole punch unit 263, the conveying path H, a pair of conveying rollers 264, a conveying path I, a staple unit 265, an eject belt 266, an eject claw 267, a drive roller 268, and a driven roller 269.

The sheet that is carried to the post-process unit 26 direction is carried to the intake sensor 262 direction by the rotation of the pair of conveying rollers 261 that is driven to rotate by the control of the control unit 101*a*.

The intake sensor 262 is used to detect that the sheet is sucked into the post-process unit 26. When the intake sensor 262 detects the leading edge of the sheet that is carried along the conveying path H, the intake sensor 262 generates an intake detection signal and sends the signal to the control unit 101*a*.

The hole punch unit 263 perforates through the sheet in which the print process is performed for filing. The hole punch unit 263 has a punch (not shown) for making a hole and a die (not shown) being a pair with the punch. Chips that are generated at the time of perforation are collected to a chip collection unit (not shown). In the hole punch unit 263, when the hole punch process is performed for the sheet in which the thickness is more than a certain amount, burr (unevenness that is created at the time of paper cutting) may be created. Therefore, the hole punch unit 263 is performed for only the sheet in which the thickness permits accurate perforation based on the control of the control unit 101*a*. In this embodiment, the hole punch unit 263 is performed for one sheet at a time. However, the present invention is not limited to the structure discussed above, and the perforation process can be applied to several sheets in which the print process is finished.

When the control unit 101*a* receives the intake detection signal, and when the hole punch process is performed, a leading edge of the sheet that is carried between the pair of varying rollers 261 abuts a nipping part that is formed between rollers of the pair of registration rollers 264 that is suspended. Then, the control unit 101*a* drives the hole punch unit 263 to perforate certain positions of the sheet. After the hole punch process is finished, the pair of conveying rollers 264 starts to rotate. Therefore, the perforated sheet is carried to the eject belt 266 direction by the rotation of the pair of rollers.

The eject belt is used to eject the perforated sheet or a group of sheets, which is stapled by the staple process discussed later, to outside of the device. As shown in FIG. 7, the eject belt 266 is an endless belt tensioned by the drive roller 268 and the driven roller 269. As shown in FIG. 7, the eject belt 266 locate in the position where the driven roller 269 is located higher than the drive roller 268 to adjust to the angle of the post-process stacker unit 27.

As shown in FIG. 7, the eject claw 267 is fixed to the eject belt 266. When the eject belt 266 is suspended, the eject claw 267 is in the initial position in the vicinity of the drive roller 268 by the control of the control unit 101*a* as shown in FIG. 7. As a result, when the sheet in which the hole punch process is performed is carried on the suspended eject belt 266 by the control of the control unit 101*a*, the trailing edge of the sheet contacts the eject claw 267 on the belt.

The suspended eject belt 266 and the eject claw 267 function as the staple stacker in which a group of sheets is loaded for stapling as one set of sheets at the time of the staple process.

When the sheet in which the hole punch process is performed is placed on the eject belt 266, the drive roller 268 rotates by the control of the control unit 101*a* and the belt starts to run. The eject claw 267 is moved to the post-process stacker unit 27 direction in accordance with the running of the eject belt 266. As a result, the trailing edge of the sheet placed on the running eject belt 266 is pushed toward the post-process stacker unit 27 direction by the eject claw 267. Then, the sheet ejected outside of the device is loaded on the post-process stacker unit 27.

The staple unit 265 has a stapler that staples a group of sheets in which the print process is performed. In the staple unit 265, when the staple process is performed by a stapler for a group of sheets in which the thickness of the group of sheets is more than a certain amount, problems may be occurred such as the stapler is broken, and the accurate stapling cannot be performed. In the staple unit 265, the staple process is performed based on the control of the control unit 101*a* discussed below so long as the thickness of the group of sheets is such that accurate stapling is possible.

When the control unit 101*a* receives the intake detection signal, and when the staple process is performed, the sheet is carried on the suspended eject belt 266 (table stacker) by rotating the pair of conveying rollers 264 by the control unit 101*a*. As a result, several sheets, which are subject to have the staple process, are loaded on the eject belt 266 (table stacker) one by one. Then, after all of sheets are loaded on the eject belt 266, the control unit 101*a* drives the staple unit 265 to staple the certain position of the sheets.

After the staple process is performed on the group of sheets, and the sheets are stapled as one set of sheets, the eject belt 266 starts to run by the rotation of the drive roller 268 through the control of the control unit 101*a*. As a result, the trailing edge of the group of sheets placed on the running eject belt 266 is pushed toward the post-process stacker unit 27 direction by the eject claw 267. Then, the group of sheets ejected outside of the device is loaded on the post-process stacker unit 27.

Figure 6:
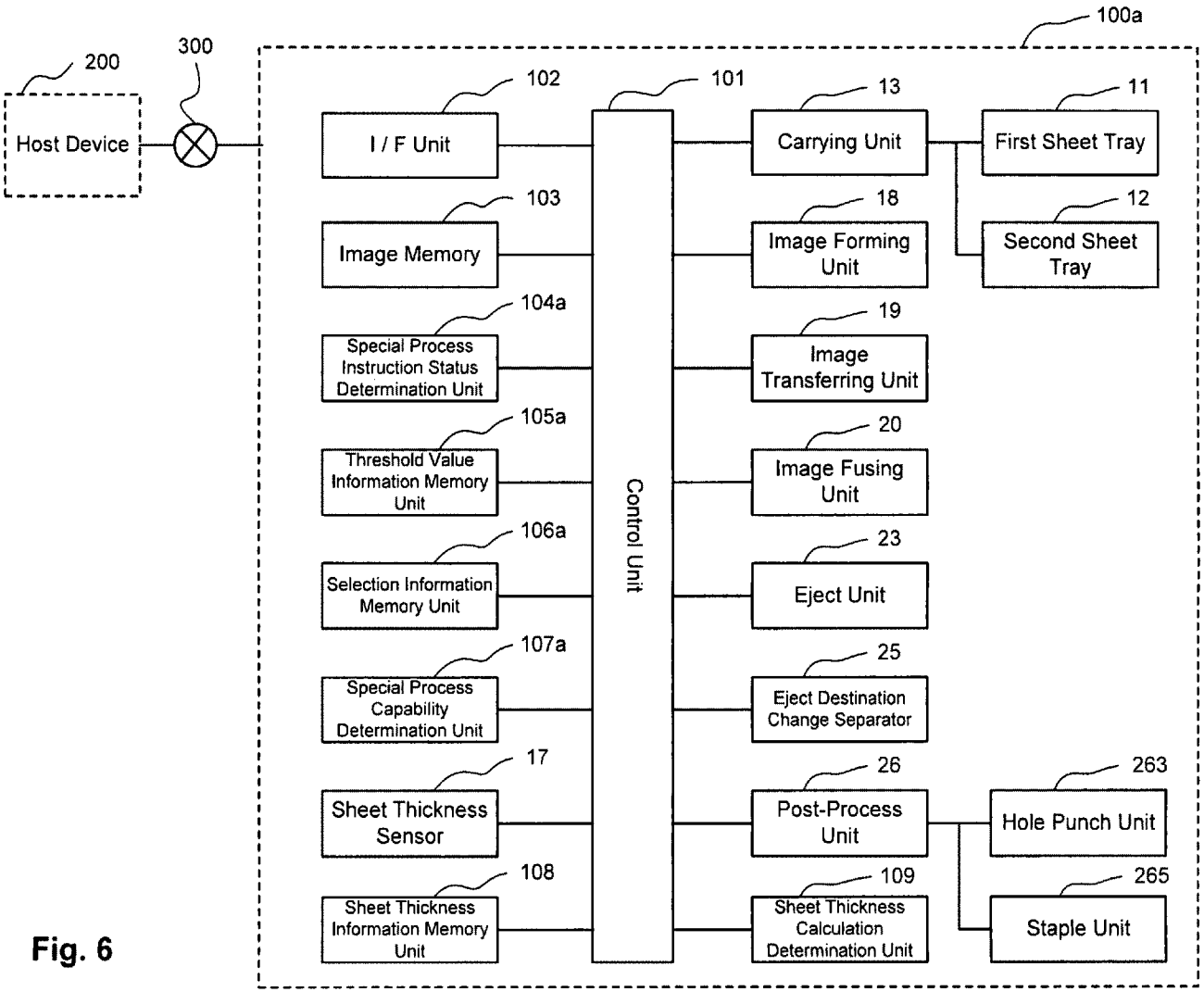
FIG. 6 is a block diagram of a control configuration of a printer 100*a* of a second embodiment.

Control configurations that are features of the printer 100*a* of the second embodiment according to the present invention are explained referring to FIG. 6. The printer 100*a* has the following structures as shown in FIG. 6: the control unit 101*a* that controls each of units in the printer 100*a* and controls overall of the printer 100*a*; an inter face (I/F) unit 102; an image memory 103; a special process instruction status determination unit 104*a*; a threshold value information memory unit 105*a*; a selection information memory unit 106*a*; a special process capability determination unit 107*a*; a sheet thickness information memory unit 108; and a sheet thickness calculation determination unit 109.

When the control unit 101*a* receives print data from the host device 200 through the I/F unit 102, the control unit 101*a* converts the print data to image data through a rasterize transformation unit that is not shown and is in the printer 100*a*. The print data contains post-process instruction information showing existence or non-existence of instructions for the hole punch process and the staple process, number of sheets information showing the total number of printed sheets, sheet size information showing a size of paper, such as A4, and sheet tray information showing automatic sheet feeding. The image data keeps the post-process instruction information, the number of sheets information, the sheet size information, and the sheet tray information that are contained in the print data. Note that one of the hole punch process and the staple process can be assigned for the post-process instruction information.

After the image data is stored in the image memory 103, the control unit 101*a* controls the drive unit to rotate the photoreceptor drum 182 and, at the same time, instructs the special process instruction status determination unit 104*a* to determine existence or non-existence of the post-process instruction.

The special process instruction status determination unit 104*a* determines existence or non-existence of the post-process instruction (hole punch process or staple process) based on the post-process instruction information contained in the image data. When the special process instruction status determination unit 104*a* receives the instruction of the special process instruction status determination, and when the post-process instruction information contained in the image data that is stored in the image memory 103 shows "existence of the hole punch process," the special process instruction status determination unit 104*a* determines that the hole punch process instruction exists.

When the post-process instruction information shows "existence of the staple process," the special process instruction status determination unit 104*a* determines that the staple process instruction exists.

On the other hand, when the post-process instruction information shows "non-existence of the hole punch process and non-existence of the staple process," the special process instruction status determination unit 104*a* determines that the post-process instruction does not exist.

As shown in FIGS. 8A, 8B and 8C the sheet thickness information memory unit 108 is a memory to store sheet thickness calculation value T (μm) showing thicknesses of the sheet 1 and/or the sheet 2 calculated by the sheet thickness sensor 17. The sheet thickness information memory unit 108 is a volatile memory in which the memory contents are deleted and initialized by the control of the control unit 101*a* when the printer 100*a* is turned off or when any of the sheet trays is ejected. When the sheet thickness information memory unit 108 is initialized by the control of the control unit 101*a*, "to be determined (TBD)" is stored in the sheet thickness information memory unit 108. "To be determined (TBD)" shows that the sheet thickness calculation value T (μm) is not yet calculated for the trays as shown in FIG. 8A.

After the sheet thickness information memory unit 108 is initialized, and when the sheet thickness sensor 17 calculates the thickness of the sheet 1 (the thickness of another sheet 2 is not calculated), the thickness of the sheet 1 is stored in the sheet thickness information memory unit 108 by the control of the control unit 101*a* as the sheet thickness calculation value T (μm) that corresponds to the first sheet tray 11 as shown in FIG. 8B.

After the sheet thickness calculation value T (μm) that corresponds to the first sheet tray 11 is stored in the sheet thickness information memory unit 108, and when the sheet thickness sensor 17 calculates the thickness of the sheet 2, the thicknesses of the sheet 1 and the sheet 2 are stored in the sheet thickness information memory unit 108 by the control of the control unit 101*a* as the sheet thickness calculation value T (μm) that corresponds to each of the trays as shown in FIG. 8C.

In FIG. 9 the threshold value information memory unit 105*a* stores the predetermined threshold value of sheet thickness at or above which the hole punch process cannot be performed. Also, the memory unit 105*a* stores the predetermined threshold value of the thickness of a group of sheets (total thickness of all sheets in the group) at which the staple process cannot be performed. In this embodiment, the threshold value at or above which the hole punch process cannot be performed is set to 190 μm (per sheet). This threshold value is obtained through experimentation with the printer 100*a* in advance to determine at what thicknesses 200 sheets could be continuously perforated in the hole punch process without any problems.

In this embodiment, the threshold value at or above with the staple process cannot be performed is set to 8000 μm (total thickness of the sheets). This threshold value is obtained through experimentation with the printer 100*a* in advance to determine at what thicknesses a set of fifty sheets could be continuously stapled two hundred times without any problems. Note that the threshold value indicates the total thickness of a set of fifty sheets (160 μm×50 sheets=8000 μm).

When the special process instruction status determination unit 104*a* determines that the hole punch process instruction exists, the control unit 101*a* instructs the sheet thickness calculation determination unit 109 to determine whether or not the thickness of the sheet 1 is calculated and forwards the type of the post-process (the hole punch process).

On the other hand, when the special process instruction status determination unit 104*a* determines that the staple process instruction exists, the control unit 101*a* instructs the sheet thickness calculation determination unit 109 to determine whether or not the thickness of the sheet 1 is calculated and forwards the type of the post-process (the staple process).

When the special process instruction status determination unit 104*a* determines that the post-process instruction does not exist, the control unit 101*a* performs the print process on the sheet 1 based on the image data. The sheet 1 in which the print process is performed is ejected from the eject unit 23 and is loaded on the stacker unit 24.

The sheet thickness calculation determination unit 109 determines whether or not the sheet thickness sensor 17 is driven based on sheet thickness information stored in the sheet thickness information memory unit 108. Namely, when the sheet thickness calculation determination unit 109 receives instruction for determination of the thickness of the sheet 1 and another sheet 2 discussed later, the sheet thickness calculation determination unit 109 searches the sheet thickness information memory unit 108 to obtain the sheet thickness calculation value T (μm) that corresponds to the thickness of the sheets loaded and held in the first sheet tray 11 or the second sheet tray 12.

When the sheet thickness calculation value T (μm) is "TBD," the sheet thickness calculation determination unit 109 determines that the drive of the sheet thickness sensor 17 is necessary. When the sheet thickness calculation determination unit 109 determines that the drive of the sheet thickness sensor 17 is necessary, the control unit 101*a* turns on the sheet thickness sensor 17. In this embodiment, when the printer 100*a* performs the print process based on the automatic sheet feeding, the control unit 101*a* rotates the first sheet feeding roller 111 by the control of the drive unit based on a program that is set in a memory (not shown) in advance. As a result, the first sheet feeding roller 111 that starts to rotate feeds the top of the sheet 1 loaded in the first sheet tray 11 to the conveying path A.

On the other hand, when the sheet thickness calculation value T (μm) is not "TBD," the sheet thickness calculation determination unit 109 determines that the drive of the sheet thickness sensor 17 is not necessary. When the sheet thickness calculation determination unit 109 determines that the drive of the sheet thickness sensor 17 is not necessary, the control unit 101*a* instructs the special process capability determination unit 107*a* to determine whether or not the special process is performed and at the same time forwards the name of sheet feeding tray (first sheet tray 11 or second sheet tray 12) in which the sheet to be determined is loaded and held and the type of the post-process (hole punch process or staple process).

When the sheet, which is carried to the conveying path A, passes the sheet thickness sensor 17, the sheet thickness sensor 17 calculates the thickness of the sheet and sends the thickness detection signal to the control unit 101*a* as discussed in the first embodiment. The thickness detection signal contains the name of sheet feeding tray and the type of the post-process.

When the control unit 101*a* receives the thickness detection signal, the sheet thickness indicated by the signal is stored as the sheet thickness calculation value T (μm) in the sheet thickness information memory unit 108 corresponding to the name of sheet feeding tray contained in the signal. When the memory process is finished, the control unit 101*a* instructs the special process capability determination unit 107*a* to determine whether or not the special process is capable and forwards the name of sheet feeding tray and the type of the post-process.

Figure 10:
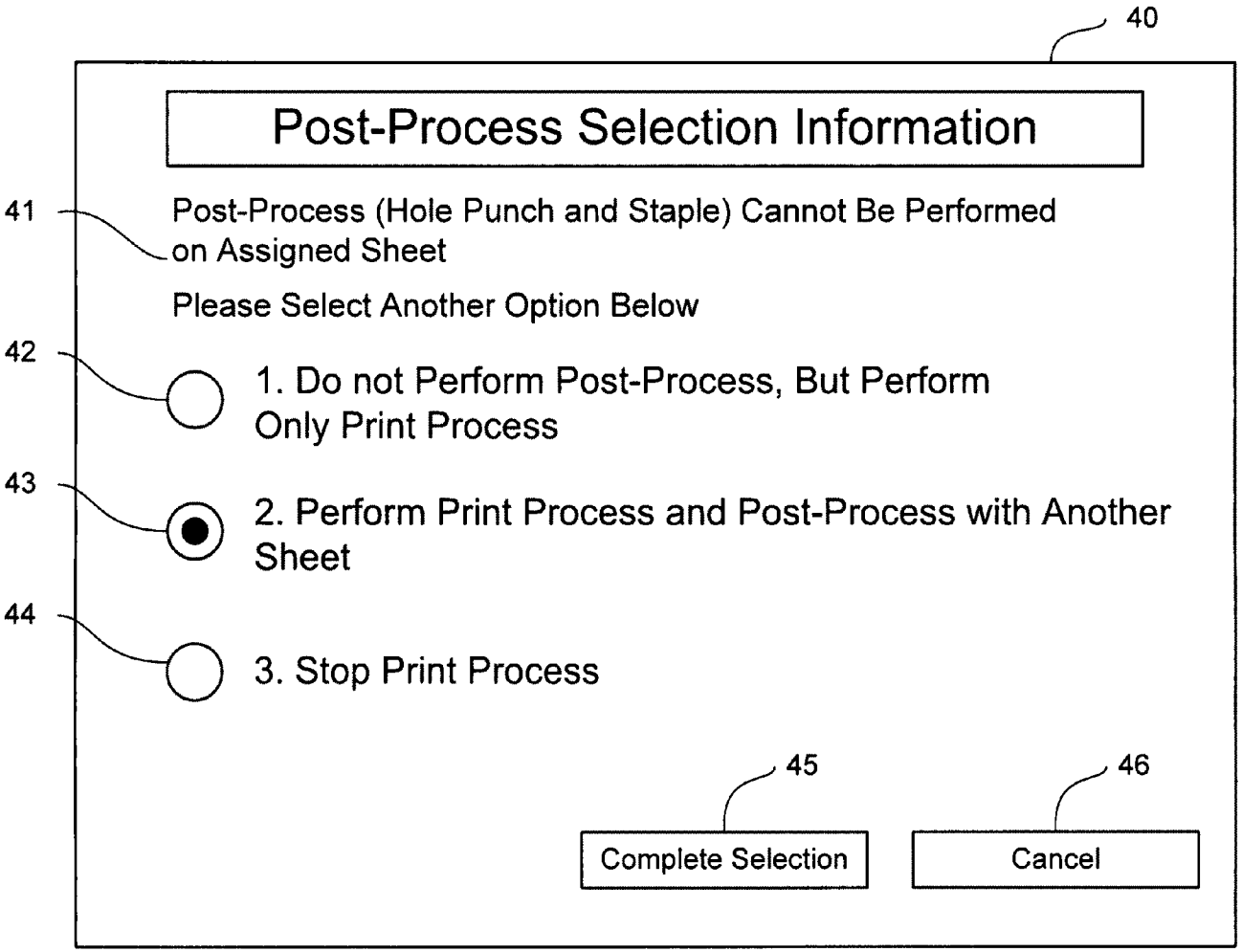
FIG. 10 is a schematic view of a display of post-process selection information of the second embodiment.

The selection information memory unit 106*a* stores predetermined post-process selection information such as "do not perform post-process, but perform only print process," "perform print process and post-process with another sheet," and "stop print process," one of which is selected by a user selects when the hole punch process or the staple process cannot be performed. The post-print selection information is explained in detail when FIG. 10 is explained later.

The special process capability determination unit 107*a* determines whether or not the hole punch process or the staple process can be performed based on the sheet thickness information stored in the sheet thickness information memory unit 108. Namely, when the special process capability determination unit 107*a* receives the name of the sheet feeding tray and the type of the post-process, and when the type of the post-process is the hole punch process, the special process capability determination unit 107*a* obtains the sheet thickness calculation value T (μm) that corresponds to the sheet tray through searching the sheet thickness information stored in the sheet thickness information memory unit 108 based on the name of the sheet feeding tray. The special process capability determination unit 107*a* compares the sheet thickness calculation value T (μm) that is obtained with the threshold value (160 μm), which is stored in the threshold information memory unit 105*a*, for the hole punch process. When the sheet thickness calculation value T (μm) is less than the threshold value (160 μm), the special process capability determination unit 107*a* determines that the hole punch process is possible. When the special process capability determination unit 107*a* determines that the hole punch process is possible, the control unit 101*a* controls the print process and then controls the hole punch process as discussed above.

On the other hand, when the sheet thickness calculation value T (μm) is equal to or more than the threshold value (160 μm), the special process capability determination unit 107*a* determines that the hole punch process is not possible. When the special process capability determination unit 107*a* determines that the hole punch process is not possible, the control unit 101*a* sends the post-process selection information that is stored in the selection information memory unit 106*a* to the host device 200. The control unit 101*a* also controls that the sheet 1 is carried between the image forming unit 18 and the image fusing unit 20 (conveying path B) without the print process when the sheet 1 is carried through the conveying unit 13. Then, the sheet in which the print process is not performed is ejected from the eject unit 23 to outside of the device through the rotation of the pair of ejecting rollers 231 and is loaded on the stacker unit 24.

When the type of the post-process is the staple process, the special process capability determination unit 107*a* search the sheet thickness information stored in the sheet thickness information memory unit 108 based on the name of the sheet feeding tray and obtains the sheet thickness calculation value T (μm) that corresponds to the sheet tray. The special process capability determination unit 107*a* compares the obtained sheet thickness calculation value T (μm) and total sheet thickness calculated by the total number of sheets information with the threshold value (8000 μm) for the staple process that is stored in the threshold value information memory unit 105*a*. When the total thickness of all of the sheets is less than the threshold value (8000 μm), the special process capability determination unit 107*a* determines that the staple process is possible. When the special process capability determination unit 107*a* determines that the staple process is possible, the control unit 101*a* controls the print process as discussed above, and then controls the staple process.

On the other hand, when the total thickness of all of the sheets is equal to or more than the threshold value (8000 μm), the special process capability determination unit 107*a* determines that the staple process is not possible. When the special process capability determination unit 107*a* determines that the staple process is not possible, the control unit 101*a* sends the post-process selection information, which is stored in the selection information memory unit 106*a*, to the host device 200 and controls that the sheet 1 is carried between the image forming unit 18 and the image fusing unit 20 (conveying path B) without the print process when the sheet 1 is carried through the conveying unit 13. Then, the sheet in which the print process is not performed is ejected from the eject unit 23 to outside of the device through the rotation of the pair of ejecting rollers 231 and is loaded on the stacker unit 24.

As shown in FIG. 10, when the host device 200 receives the post-process selection information from the printer 100*a*, the host device 200 shows the information on a display unit shown as a form 40 in FIG. 10.

As shown in FIG. 10, the form 40 has a message 41 notifying that the post-process (hole punch process and staple process) cannot be performed on the sheet assigned by a user, selection buttons 42, 43, and 44 corresponding to three options, "1. Do Not Perform Pos-Process, but Perform Only Print Process," "2. Perform Print Process and Post-Print Process with Another Sheet," "3. Stop Print Process," respectively, a "Complete Selection" button 45, and a "Cancel" button 46.

When the user refers the form 40 showing on the display unit of the host device 200, selects the selection button 42 through an input unit (not shown) corresponding to "1. Do Not Perform Pos-Process, but Perform Only Print Process," and pushes the "Complete Selection" button 45, a control unit (not shown) of the host device 200 generates response information containing the "Perform Only Print Process" option and sends the information to the printer 100*a*.

Alternatively, when the user selects the selection button 43 corresponding to "2. Perform Print Process and Post-Print Process with Another Sheet," and pushes the "Complete Selection" button 45, the control unit of the host device 200 generates response information containing the "Perform Print Process and Post-Print Process with Another Sheet" option and sends the information to the printer 100*a*.

Further alternatively, when the user selects the selection button 44 corresponding to "3. Stop Print Process," and pushes the "Complete Selection" button 45, the control unit of the host device 200 generates response information containing the "Stop Print Process" option and sends the information to the printer 100*a*.

When the control unit 101*a* of the printer 100*a* receives the response information from the host device 200, and when the response information shows the "Perform Only Print Process" option, the control unit 101*a* rotates the first sheet feeding roller 111 by driving the drive unit and feeds the top of the sheet 1 loaded in the first sheet tray 11 to the conveying path A. Then, the print process is performed on the sheet 1 based on image data stored in the image memory 103. The sheet 1 in which the print process is finished is ejected from the eject unit 23 to outside of the device by the control of the control unit 101*a* and is loaded on the stacker unit 24.

Alternatively, when the response information shows "Perform Print Process and Post-Print Process with Another Sheet," the control unit 101*a* instructs the sheet thickness calculation determination unit 109 to determine whether or not the calculation of the thickness of another sheet 2 is possible and forwards the type of the post-process (hole punch process or staple process). When the sheet thickness calculation determination unit 109 determines that the calculation of the thickness of another sheet 2 is possible, the sheet thickness sensor 17 turns on by the control of the control unit 101*a* and calculates the thickness of another sheet 2. The calculated thickness of the other sheet 2 is stored into the sheet thickness information memory unit 108 as the sheet thickness calculation value T (μm) that corresponds to the sheet thickness information of the second sheet tray 12 by the control of the control unit 101*a*. Then, when the special process capability determination unit 107*a* determines that the hole punch process or the staple process is possible, the hole punch process or the staple process is performed by using the other sheet 2. The sheet or the group of sheets for which the above described process is finished is ejected to outside of the device through the eject belt 266 by the control of the control unit 101*a* and is loaded on the post-process stacker unit 27. In this embodiment, because the printer 100*a* is capable of performing the post-process, the sheet loaded and held in at least one of the first sheet tray 11 and the second sheet tray 12 should have a thickness that qualifies for the post-process.

Further alternatively, when the response information shows "Stop Print Process," the control unit 101*a* deletes the image data stored in the image memory 103 by using an image delete unit (not shown). Then, the printer 100*a* is in a print data waiting state by the control of the control unit 101*a*.

Figure 11:
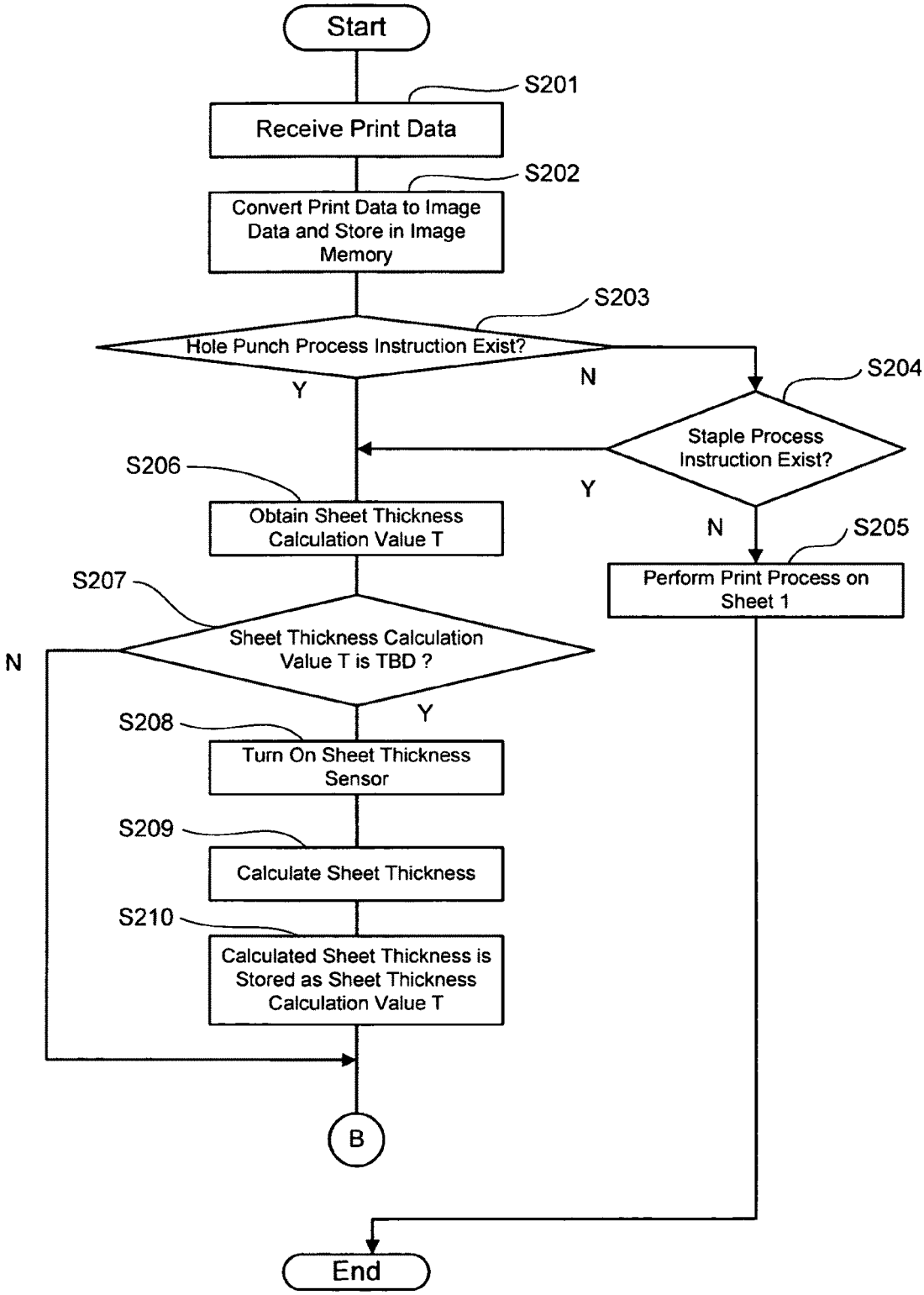
FIG. 11 is a flow diagram of operation of the printer 100*a* of the second embodiment.
Figure 12:
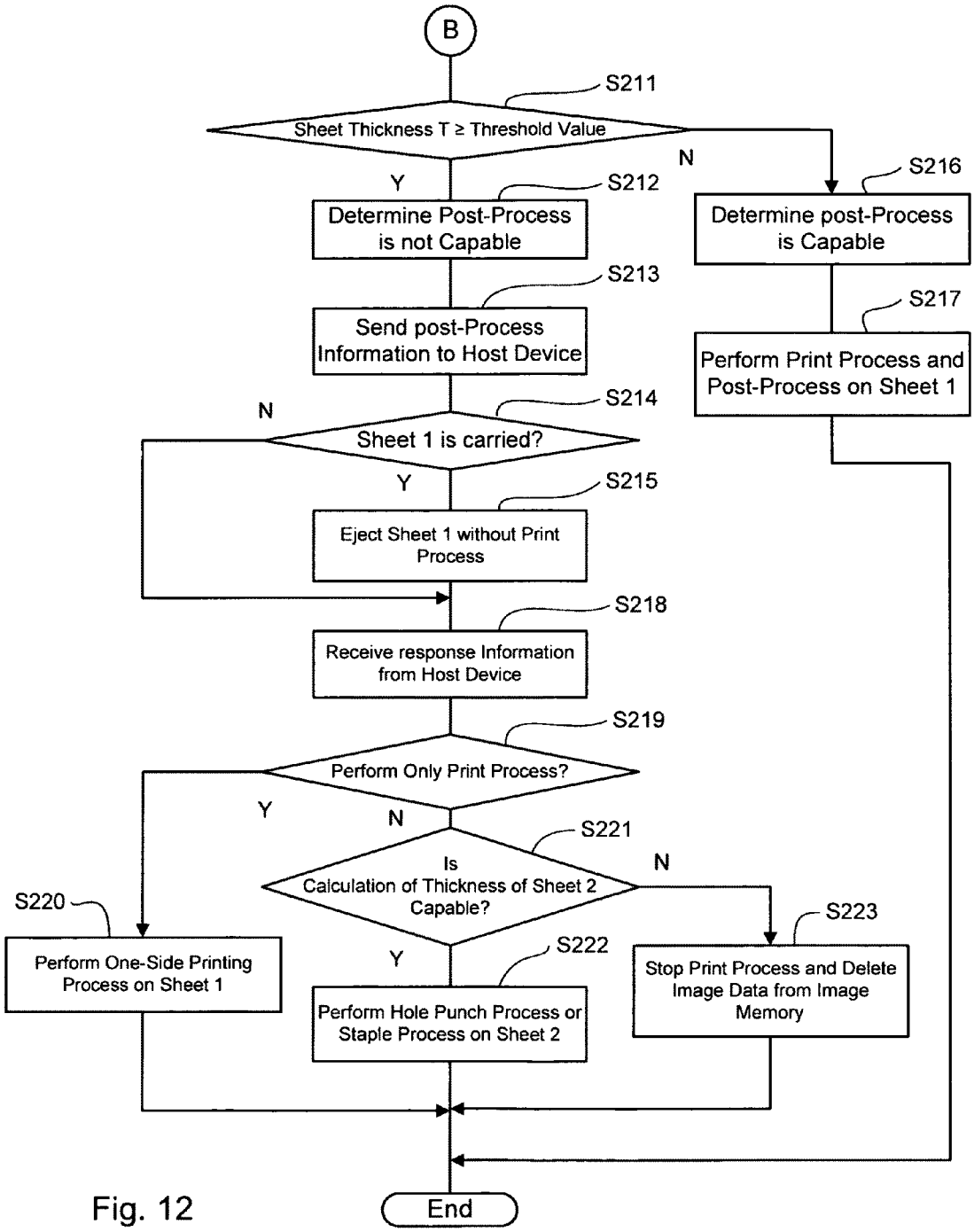
FIG. 12 is a flow diagram of operation of the printer 100*a* of the second embodiment.

FIGS. 11 and 12 are flow diagrams of operation of the printer 100*a* of the second embodiment according to the present invention. Operation of the printer 100*a* of the second embodiment according to the present invention is explained with reference to the flow diagrams in FIGS. 11 and 12. The first sheet tray 11 loads and holds the sheet 1 that has the following characteristics: the quality of a sheet is normal (normal paper); the size of a sheet is A4; and the thickness of a sheet is 190 μm. Similarly, the second sheet tray 12 loads and holds the sheet 2 that has the following characteristics: the quality of a sheet is normal (normal paper); the size of a sheet is A4; and the thickness of a sheet is 80 μm.

When the control unit 101*a* of the printer 100*a* receives print data from the host device 200 through the I/F unit 102 (S201), the control unit 101*a* converts the print data to image data through a rasterize transformation unit that is not shown and is in the printer 100*a*. The print data contains the post-process instruction information showing existence or non-existence of the hole punch process and the staple process, number of sheets information showing total number of paper for printing (50 sheets), sheet size information showing a size of paper, such as A4, and sheet tray information showing automatic sheet feeding. The image data keeps the post-process instruction information, the number of sheet information, the sheet size information, and the sheet tray information that are contained in the print data.

After the image data is stored in the image memory 103 (S202), the control unit 101*a* controls the drive unit to rotate the photoreceptor drum 182 and, at the same time, instructs the special process instruction status determination unit 104*a* to determine existence or non-existence of the post-process instruction.

When the special process instruction status determination unit 104*a* receives the instruction containing existence or non-existence of the special process instruction, and when the post-process instruction information indicates the "existence of the hole punch process," the special process instruction status determination unit 104*a* determines that the hole punch process instruction exists (S203).

When the post-process instruction information indicates the "existence of the staple process," the special process instruction status determination unit 104*a* determines that the staple process instruction exists (S204).

On the other hand, when the post-process instruction information indicates the "non-existence of the hole punch process and non-existence of the staple process," the special process instruction status determination unit 104*a* determines that the post-process instruction does not exist.

When the special process instruction status determination unit 104*a* determines that the hole punch process instruction exists, the control unit 101*a* instructs the sheet thickness calculation determination unit 109 to determine whether or not the thickness of the sheet 1 is calculated and forwards the type of the post-process (the hole punch process).

On the other hand, when the special process instruction status determination unit 104*a* determines that the staple process instruction exists, the control unit 101*a* instructs the sheet thickness calculation determination unit 109 to determine whether or not the thickness of the sheet 1 is calculated and forwards the type of the post-process (the staple process).

When the special process instruction status determination unit 104*a* determines that the post-process instruction does not exist, the control unit 101*a* performs the print process on the sheet 1 based on the image data (S205). The sheet 1 in which the print process is performed is ejected from the eject unit 23 and is loaded on the stacker unit 24.

When the sheet thickness calculation determination unit 109 receives instruction for determination of the thickness of the sheet 1 and another sheet 2 discussed later, the sheet thickness calculation determination unit 109 searches the sheet thickness information memory unit 108 to obtain the sheet thickness calculation value T (μm) that corresponds to the thickness of the sheets loaded and held in the first sheet tray 11 or the second sheet tray 12 (S206).

When the sheet thickness calculation value T (μm) is "TBD" (S207), the sheet thickness calculation determination unit 109 determines that the drive of the sheet thickness sensor 17 is necessary. When the sheet thickness calculation determination unit 109 determines that the drive of the sheet thickness sensor 17 is necessary, the control unit 101*a* turns on the sheet thickness sensor 17 (S208). When the printer 100*a* performs the print process based on the automatic sheet feeding, the control unit 101*a* rotates the first sheet feeding roller 111 by the control of the drive unit based on a program that is set in a memory (not shown) in advance. As a result, the first sheet feeding roller 111 that starts to rotate feeds the top of the sheet 1 loaded in the first sheet tray 11 to the conveying path A.

On the other hand, when the sheet thickness calculation value T (μm) is not "TBD," the sheet thickness calculation determination unit 109 determines that the drive of the sheet thickness sensor 17 is not necessary. When the sheet thickness calculation determination unit 109 determines that the drive of the sheet thickness sensor 17 is not necessary, the control unit 101*a* instructs the special process capability determination unit 107*a* to determine whether or not the special process is performed and at the same time forwards the name of sheet feeding tray (first sheet tray 11) and the type of the post-process (hole punch process or staple process).

When the sheet, which is carried to the conveying path A, passes the sheet thickness sensor 17, the sheet thickness sensor 17 calculates the thickness (190 μm) of the sheet (S209) and sends the thickness detection signal to the control unit 101*a*. The thickness detection signal contains the name of sheet feeding tray (first sheet tray 11) and the type of the post-process.

When the control unit 101*a* receives the thickness detection signal, the sheet thickness (190 μm) indicated by the signal is stored as the sheet thickness calculation value T (μm) in the sheet thickness information memory unit 108 corresponding to the name of sheet feeding tray contained in the signal (S210). When the memory process is finished, the control unit 101*a* instructs the special process capability determination unit 107*a* to determine whether or not the special process is possible and forwards the name of sheet feeding tray (first sheet tray 11) and the type of the post-process.

When the special process capability determination unit 107*a* receives the name of sheet feeding tray (first sheet tray 11) and the type of the post-process, and when the type of the post-process is the hole punch process, the special process capability determination unit 107*a* obtains the sheet thickness calculation value T (190 μm) that corresponds to the sheet tray through searching the sheet thickness information stored in the sheet thickness information memory unit 108 based on the name of the sheet feeding tray. The special process capability determination unit 107*a* compares the obtained sheet thickness calculation value T (190 μm) with the threshold value (160 μm), which is stored in the threshold information memory unit 105*a*, for the hole punch process. Because the sheet thickness calculation value T (190 μm) is more than the threshold value (160 μm) (S211), the special process capability determination unit 107*a* determines that the hole punch process is not possible (S212). When the special process capability determination unit 107*a* determines that the hole punch process is not possible, the control unit 101*a* sends the post-process selection information that is stored in the selection information memory unit 106*a* to the host device 200 (S213). The control unit 101*a* also controls that the sheet 1 is carried between the image forming unit 18 and the image fusing unit 20 (conveying path B) without the print process when the sheet 1 is carried through the conveying unit 13 (S214). Then, the sheet in which the print process is not performed is ejected from the eject unit 23 to outside of the device through the rotation of the pair of ejecting rollers 231 and is loaded on the stacker unit 24 (S215).

On the other hand, when the sheet thickness calculation value T (μm) is less than the threshold value (160 μm), the special process capability determination unit 107*a* determines that the hole punch process is possible (S216). When the special process capability determination unit 107*a* determines that the hole punch process is possible, the control unit 101*a* controls the print process for the sheet 1 and then controls the hole punch process (S217).

When the type of the post-process is the staple process, the special process capability determination unit 107*a* search the sheet thickness information stored in the sheet thickness information memory unit 108 based on the name of the sheet feeding tray (first sheet tray 11) and obtains the sheet thickness calculation value T (190 μm) that corresponds to the first sheet tray. The special process capability determination unit 107*a* compares the obtained sheet thickness calculation value T (190 μm) and total sheet thickness (9500 μm) calculated by the total number (fifty sheets) of sheets information with the threshold value (8000 μm) for the staple process that is stored in the threshold value information memory unit 105*a*. Because the total thickness (9500 μm) of all of the sheets is more than the threshold value (8000 μm), the special process capability determination unit 107*a* determines that the staple process is not possible. When the special process capability determination unit 107*a* determines that the staple process is not possible, the control unit 101*a* sends the post-process selection information, which is stored in the selection information memory unit 106*a*, to the host device 200 and controls that the sheet 1 is carried between the image forming unit 18 and the image fusing unit 20 (conveying path B) without the print process when the sheet 1 is carried through the conveying unit 13. Then, the sheet in which the print process is not performed is ejected from the eject unit 23 to outside of the device through the rotation of the pair of ejecting rollers 231 and is loaded on the stacker unit 24.

On the other hand, when the total thickness of all of the sheets is less than the threshold value (8000 μm), the special process capability determination unit 107*a* determines that the staple process is possible. When the special process capability determination unit 107*a* determines that the staple process is possible, the control unit 101*a* controls the print process for the sheet 1 as discussed above, and then controls the staple process.

When the host device 200 receives the post-process selection information from the printer 100*a*, the host device 200 shows the information on a display unit shown as the form 40 in FIG. 10.

When the user refers the form 40 showing on the display unit of the host device 200, selects the selection button 42 through an input unit (not shown) corresponding to "1. Do Not Perform Pos-Process, but Perform Only Print Process," and pushes the "Complete Selection" button 45, a control unit (not shown) of the host device 200 generates response information containing the "Perform Only Print Process" option and sends the information to the printer 100*a*.

Alternatively, when the user selects the selection button 43 corresponding to "2. Perform Print Process and Post-Print Process with Another Sheet," and pushes the "Complete Selection" button 45, the control unit of the host device 200 generates response information containing the "Perform Print Process and Post-Print Process with Another Sheet" option and sends the information to the printer 100*a*.

Further alternatively, when the user selects the selection button 44 corresponding to "3. Stop Print Process," and pushes the "Complete Selection" button 45, the control unit of the host device 200 generates response information containing the "Stop Print Process" option and sends the information to the printer 100*a*.

When the control unit 101*a* of the printer 100*a* receives the response information from the host device 200 (S218), and when the response information shows the "Perform Only Print Process" option (S219), the control unit 101*a* rotates the first sheet feeding roller 111 by driving the drive unit and feeds the top of the sheet 1 loaded in the first sheet tray 11 to the conveying path A. Then, the print process is performed on the sheet 1 based on image data stored in the image memory 103 (S220). The sheet 1 in which the print process is finished is ejected from the eject unit 23 to outside of the device by the control of the control unit 101*a* and is loaded on the stacker unit 24.

Alternatively, when the response information shows "Perform Print Process and Post-Print Process with Another Sheet," the control unit 101*a* instructs the sheet thickness calculation determination unit 109 to determine whether or not the calculation of the thickness of another sheet 2 can be performed and forwards the type of the post-process (hole punch process or staple process). When the sheet thickness calculation determination unit 109 determines that the calculation of the thickness of another sheet 2 is possible, the sheet thickness sensor 17 turns on by the control of the control unit 101*a* and calculates the thickness (80 μm) of another sheet 2 (S221). The calculated thickness (80 μm) of another sheet 2 is stored into the sheet thickness information memory unit 108 as the sheet thickness calculation value T (μm) that corresponds to the sheet thickness information of the second sheet tray 12 by the control of the control unit 101*a*. And then, when the special process capability determination unit 107*a* determines that the hole punch process or the staple process is possible, the hole punch process or the staple process is performed by using another sheet 2 (S222). The sheet or the group of sheets in which the above described process is finished is ejected to outside of the device through the eject belt 266 by the control of the control unit 101*a* and is loaded on the post-process stacker unit 27.

Further alternatively, when the response information shows "Stop Print Process," the control unit 101*a* stops the print process and deletes the image data stored in the image memory 103 by using an image delete unit (not shown) (S223). Then, the printer 100*a* is in a print data waiting state by the control of the control unit 101*a*.

Because in the printer 100*a* of the second embodiment, the thickness of each sheet in each sheet tray that is calculated through the sheet thickness sensor 17 is stored in the sheet thickness information memory unit 108, the sheet thickness that qualifies for the special process is determined without calculation for each sheet at each print process. Therefore, the time required to determine whether or not the special process is possible can be shortened. Number of sheets that is supplied and that is loaded on the stacker unit 24 without print process can be decreased.

In the second embodiment, the printer 100*a* performs the one-side printing. However, the present invention is not limited to the structure discussed above and is applied to duplex printing. In this case, the printer 100*a* can perform duplex printing and the post-process (hole punch process and staple process).

In the first and second embodiments, because the printers 100 and 100*a* need to determine whether or not duplex printing, the hole punch process and the staple process can be performed on the sheets 1 and 2, the sheet thickness sensor 17 is used to obtain the thickness of the sheets. However, the present invention is not limited to the structure discussed above and is applied to structures in which the hardness of the sheet is obtained as the characteristics of the sheet, or a reflective photo sensor is used to determine whether or not the sheet is for OHP.

In this case, when the hardness of the sheet is equal to or more than the threshold value that is a certain value of the hardness or the sheet is for OHP, the printers 100 and 100*a* determines that the duplex printing, the hole punch process and the staple process cannot be performed. On the other hand, when the hardness of the sheet is less than the threshold value that is a certain value of the hardness or the sheet is not for OHP, the printers 100 and 100*a* determines that the above each process can be performed.

When the printer 100 determines whether or not the sheet 1 or another sheet 2 qualifies for duplex printing, the size of each sheet is determined by the relationship between the period of time that the sensor turns on and the sheet feeding speed, or the reflection ratio of a photo sensor determines whether or not each sheet is the reverse-side up.

In the structure discussed above, the printer 100 determines that duplex printing is not possible because of structural restrictions when the size of the sheet is less than A6. The printer 100 also determines that duplex printing is not possible when the sheet is already printed on one side and is ready to be printed on the reverse side. On the other hand, the printer 100 determines that duplex printing is possible when the size of the sheet is equal to or larger than A6, and both sides of the sheet are yet not printed.

In the embodiments discussed above, the printer as the image forming device is explained. However, the present invention is not limited to the structure discussed above and may be applicable to a multifunction peripheral (MFP) that incorporates one of the following functions: a printer function; a copier function; a facsimile function; and a scanner function. The image forming device being thus described, it will be apparent that the same may be varied in many ways. Such variations are not to be regarded as a departure from the spirit and scope of the invention, and all such modifications as would be apparent to one of ordinary skill in the art are intended to be included within the scope of the following claims.

What is claimed is:

1. An image forming device comprising:

a first medium container, which contains a first printing medium; a second medium container, which contains a second printing medium;

a medium feeder for feeding one of the first and second media from one of the first and second medium containers;

a special process unit that performs a special process on the first printing medium fed by the medium feeder when image data, which includes instruction information instructing the special process, is received;

a detector that detects a characteristic of the first printing medium;

a special process capability determination unit for determining whether or not the special process instructed by the instruction information can be performed based on the characteristic; and a control unit that ejects the first printing medium and that causes the second medium to be fed from the second medium container when the special process capability determination unit determines that the special process cannot be performed.

2. The image forming device according to claim 1, wherein the image forming device further comprises: a memory unit that stores selection information that is used by a user to select whether or not the special process is performed on the second printing medium; and a special process confirmation unit that obtains the selection information from the memory unit and that outputs the selection information when it is determined that the special process cannot be performed.

3. The image forming device according to claim 2, wherein the special process confirmation unit sends the selection information to a host device that is a source of image data.

4. The image forming device according to claim 2, wherein the special process confirmation unit has a display and shows the selection information on the display.

5. The image forming device according to claim 1, wherein the image forming device further comprises:

a characteristic information memory unit that stores the characteristic detected by the detector as characteristic information that corresponds to the first and second medium containers, wherein the control unit is configured to obtain image data that contains the instruction information, the medium feeder feeds the medium from a selected one of the medium containers based on the instruction information, and the control unit searches the characteristic information memory unit of the selected medium container to determine whether or not the characteristic information is stored, when the characteristic information is not stored, the control unit causes the medium feeder to feed the printing medium contained in the selected medium container, and causes the detector to detect the characteristic of the printing medium that is fed, and the special process capability determination unit determines whether or not the special process, which is instructed by the instruction information, can be performed based on the characteristic information stored in the characteristic information memory unit.

6. The image forming device according to claim 1, wherein the special process unit performs one or more of a duplex printing process, a hole punch process, and a staple process, the detector detects a thickness of the printing medium, and the special process capability determination unit compares the detected thickness with a predetermined threshold value, and the special process capability determination unit determines that the special process cannot be performed when the detected thickness is equal to or more than the threshold value.

7. The image forming device according to claim 1, wherein the special process unit performs one or more of duplex printing, a hole punch process, and a staple process, the detector detects a hardness of the printing medium, and the special process capability determination unit compares the detected hardness with a predetermined threshold value, and the special process capability determination unit determines that the special process cannot be performed when the detected hardness is equal to or more than the threshold value.

8. The image forming device according to claim 1, wherein the special process unit performs duplex printing, the detector detects the size of the printing medium, and the special process capability determination unit determines that the duplex printing is not possible when the detected size is less than A6 size.

9. The image forming device according to claim 1, wherein the special process unit performs one or more of duplex printing, a hole punch process, and a staple process, the detector detects whether or not the printing medium is an OHP medium, and the special process capability determination unit determines that the special process instructed by the instruction information cannot be performed when the printing medium is the OHP medium.

10. The image forming device according to claim 1, wherein the special process unit performs duplex printing, the detector detects whether or not printing has occurred on one side of the printing medium, and the special process capability determination unit determines that the duplex printing cannot be performed when printing has occurred on one side of the printing medium.

11. An image forming device for performing an image forming process comprising:

a first sheet container, which contains sheets of a first type;

a second sheet container, which contains sheets of a second type;

a sheet feeding apparatus for feeding sheets from one of the first and second sheet containers to a conveying path;

a special process unit that performs a special process on the sheets in addition to the image forming process when image data, which includes instruction information instructing the special process, is received;

a detector that detects a characteristic of a sheet of the first type on which an image is to be formed; and a control unit for determining whether or not the sheet of the first type qualifies for the special process instructed by the instruction information based on the characteristic, wherein if the control unit determines that the sheet of the first type fails to qualify for the special process, the control unit causes a display to present a list of options to a user, wherein one of the options is to use the sheets of the second type for the image forming process.

12. The image forming device according to claim 11, wherein the image forming device includes a sheet conveying path, and the detector detects the characteristic when the sheet of the first type is in the conveying path.

13. The image forming device according to claim 11, wherein the detector detects one of sheet thickness, sheet hardness and sheet size.

14. The image forming device according to claim 11, wherein the control unit compares the detected characteristic with a predetermined threshold value to determine whether the sheet of the first type qualifies for the special process.

15. The image forming device according to claim 11, wherein the control unit stores data representing the detected characteristic in association with the first and second sheet containers.

16. The image forming device according to claim 11, wherein the special process unit reverses the sheet for duplex printing.

17. The image forming device according to claim 11, wherein the special process is duplex printing, and one of the options is to change to one-sided printing.

18. An image forming method comprising:

receiving image data, wherein the image data includes instruction information for instructing that a special process be performed in addition to image formation;

feeding a sheet from one of first and second medium containers to a conveying path;

detecting a characteristic of the sheet; and determining whether or not the sheet qualifies for the special process based on the characteristic, wherein if the sheet qualifies for the special process, the method includes performing the special process on the sheet; and if the sheet fails to qualify for the special process, the method includes presenting a list of options on a display, and one of the options corresponds to an instruction for the image forming device to feed a sheet from the other of the first and second medium containers for the image forming process.

19. The image forming method according to claim 18 wherein:

the special process is one or more of a duplex printing process, a hole punch process, and a staple process, the detecting a characteristic includes detecting a thickness of the sheet, the method includes comparing the detected thickness with a predetermined threshold value; and the method includes determining that the special process cannot be performed when the detected thickness is equal to or more than the threshold value.

* * * * *